US008303033B2

(12) United States Patent
Lundeen

(10) Patent No.: US 8,303,033 B2
(45) Date of Patent: Nov. 6, 2012

(54) INFANT SUPPORT STRUCTURE WITH SUPPORTED SEAT

(75) Inventor: Michael Lundeen, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 162 days.

(21) Appl. No.: 12/900,155

(22) Filed: Oct. 7, 2010

(65) Prior Publication Data

US 2011/0241387 A1 Oct. 6, 2011

Related U.S. Application Data

(63) Continuation-in-part of application No. 12/719,106, filed on Mar. 8, 2010.

(60) Provisional application No. 61/159,706, filed on Mar. 12, 2009.

(51) Int. Cl.
*A47D 13/04* (2006.01)

(52) U.S. Cl. ..... 297/5; 297/6; 297/136; 297/137; 297/273; 297/274; 446/227

(58) Field of Classification Search ..... 297/5, 6, 297/16.1, 136, 137, 273, 274; 446/227
See application file for complete search history.

(56) References Cited

U.S. PATENT DOCUMENTS 2,700,413 A * 1/1955 Williams ..... 297/182
3,172,696 A * 3/1965 De Vos ..... 297/136 X
3,747,596 A * 7/1973 Mills ..... 128/869
3,796,430 A * 3/1974 Sudo ..... 297/5 X
4,019,756 A * 4/1977 Ishida ..... 297/5 X
4,025,083 A * 5/1977 Saint ..... 297/5 X
4,045,045 A * 8/1977 Boucher et al. ..... 297/5 X
4,094,547 A * 6/1978 Zampino et al. ..... 297/135 X
4,140,311 A * 2/1979 Murakami ..... 297/5 X
4,171,132 A * 10/1979 Kassai ..... 297/5 X
4,171,847 A * 10/1979 Tukui ..... 297/5
4,225,146 A * 9/1980 Takeuchi ..... 297/5 X
4,231,582 A * 11/1980 Moss ..... 297/5 X
4,298,228 A * 11/1981 Zampino et al. ..... 297/135 X
4,359,242 A * 11/1982 Gerken et al. ..... 297/5
(Continued)

FOREIGN PATENT DOCUMENTS

JP 9-70340 3/1997
(Continued)

OTHER PUBLICATIONS

International Search Report and Written Opinion for PCT/US2010/026586, dated Oct. 13, 2010, 8 pages.

*Primary Examiner* — Rodney B White
(74) *Attorney, Agent, or Firm* — Edell, Shapiro & Finnan, LLC

(57) ABSTRACT

An infant support structure includes a frame member defining a central area, a seat disposed in the central area and coupled to the frame member, and a leg member pivotally coupled to the frame member and movable between a deployed position extending outwardly from the frame member and a folded position adjacent the frame member. A support member has a first end movably coupled to the frame member and an opposite second end pivotally and slidably coupled to the leg member. The second end is slidable along the leg member as the leg member is moved between the deployed position and the folded position.

20 Claims, 33 Drawing Sheets

U.S. PATENT DOCUMENTS 4,364,576 A * 12/1982 Kassai ..... 297/136 X
4,576,392 A * 3/1986 Quinlan, Jr. ..... 297/5 X
4,579,359 A * 4/1986 Schwartz ..... 297/6 X
4,615,523 A * 10/1986 Chen ..... 297/5 X
4,743,008 A * 5/1988 Fermaglich et al. ..... 297/137 X
4,822,030 A * 4/1989 Cone ..... 297/5 X
5,054,851 A * 10/1991 Chiu ..... 297/136
5,407,246 A * 4/1995 Meeker et al. ..... 297/137
5,447,319 A * 9/1995 Huang ..... 297/5 X
5,451,093 A * 9/1995 Petrie et al. ..... 297/137
5,518,475 A * 5/1996 Garland ..... 482/68
5,688,211 A * 11/1997 Myers ..... 297/5 X
5,690,383 A * 11/1997 Meeker ..... 297/274
5,700,201 A * 12/1997 Bellows et al. ..... 297/137 X
5,728,030 A * 3/1998 Hsieh ..... 482/66
5,732,961 A * 3/1998 Theodoropoulos ..... 297/6 X
5,813,681 A * 9/1998 Saint et al. ..... 297/5 X
5,857,944 A * 1/1999 Cone et al. ..... 482/66
5,934,747 A * 8/1999 Garland ..... 297/136
6,016,926 A * 1/2000 Smith et al. ..... 446/227 X
6,179,376 B1 * 1/2001 Meeker et al. ..... 297/137
6,244,606 B1 * 6/2001 Yang ..... 297/5 X
6,260,867 B1 7/2001 Yang et al.
6,299,247 B1 * 10/2001 Meeker et al. ..... 297/137
6,592,425 B2 * 7/2003 Bapst et al. ..... 446/227
6,637,814 B1 * 10/2003 Bellows et al. ..... 297/137
6,682,139 B2 * 1/2004 Bellows et al. ..... 297/136
6,715,826 B2 * 4/2004 Bellows et al. ..... 297/136
6,817,864 B1 * 11/2004 Martinez ..... 446/227 X
6,854,799 B1 * 2/2005 Asbach et al. ..... 297/136
6,860,786 B2 * 3/2005 Oren et al. ..... 446/227
6,896,575 B2 * 5/2005 Fair et al. ..... 446/227
7,017,924 B1 3/2006 Lambert
7,510,238 B2 * 3/2009 McClintock et al. ..... 297/137
7,523,984 B2 * 4/2009 Steininger ..... 446/227 X
2004/0119258 A1 * 6/2004 Yoo ..... 280/87.051
2005/0026536 A1 * 2/2005 Armbruster et al. ..... 446/227
2008/0113581 A1 * 5/2008 Jazenski et al. ..... 446/227
2009/0230735 A1 * 9/2009 Chen ..... 297/16.1

FOREIGN PATENT DOCUMENTS

JP 2001017280 A 1/2001

* cited by examiner

INFANT SUPPORT STRUCTURE WITH SUPPORTED SEAT

CROSS-REFERENCE TO RELATED APPLICATIONS

This application is a continuation-in-part of U.S. Non-Provisional application Ser. No. 12/719,106, filed Mar. 8, 2010, entitled "Infant Support Structure with Supported Seat," which is based on and claims priority to U.S. Provisional Application Ser. No. 61/159,706, filed Mar. 12, 2009, entitled "Infant Support Structure with Supported Seat," the disclosures of both of which are incorporated herein by reference in their entireties.

FIELD OF THE INVENTION

The present invention relates to an infant support structure and in particular, to an infant support structure that supports a child above a support surface. The present invention also relates to an infant support structure that includes a frame, a seat, and a member that supports the seat for movement in various directions relative to the frame.

BACKGROUND OF THE INVENTION

Infant support structures typically support an infant or child above a support surface, such as a floor or the ground. Some infant support structures include a seat that is configured to support a child so that the child can bounce while being supported by the seat. For example, a bouncer includes a frame that is configured to allow a child supported thereon to bounce relative to the support surface. However, the particular movement of the child on the structure and the resulting entertainment for the child is limited.

Thus, there is a need for an infant support structure that facilitates different movements of a child supported by the structure. In addition, there is also a need for an infant support structure that includes a feature that can be used to entertain a child supported by the structure.

SUMMARY OF THE INVENTION

In one embodiment, an infant support structure includes a seat portion, a frame, and an elastic member. The seat portion has an outer perimeter, the frame includes an upper portion and a support portion coupled to the upper portion, the support portion being configured to engage a support surface, the upper portion substantially surrounding the seat portion, and the elastic member is coupled to the frame and to the seat portion, the elastic member substantially surrounding the seat portion. The upper portion of the frame may be substantially circular and may surround the outer perimeter of the seat portion. In one embodiment, the elastic member is a stretchable fabric material that extends between the seat portion and the frame. An object may be coupled to the elastic member so that movement of a child in the seat portion results in movement of the elastic member which imparts movement to the object.

In one embodiment, the infant support structure may include a resilient member coupled to the frame and to the seat portion, the resilient member supporting the seat portion from the frame. In addition, the resilient member is an elongate member that is coupled to the frame and the seat portion and in one implementation, the resilient member is located beneath the elastic member.

In another embodiment, a structure for supporting a person above a support surface has a frame including an outer member and legs supporting the outer member above the support surface, a seat configured to receive a child therein, a suspension mechanism coupled to the frame outer member and to the seat, and an elastic member coupled to the frame outer member and to the seat, the elastic member being substantially planar and configured to support objects placed thereon.

The suspension mechanism supports the seat from the frame, the seat being movable relative to the frame. In one embodiment, the suspension mechanism is an elastic elongate member that is coupled to the seat and to the frame. In addition, the elastic member may be a stretchable fabric material. The outer member of the frame defines a substantially circular opening, the seat is placed in the opening, and the elastic member is disposed between the outer member and the seat and surrounds the seat. In one implementation, the structure includes at least one toy that is coupled to the elastic member and configured to move when motion is imparted to the elastic member.

In one embodiment, the infant support structure includes a seat configured to receive an infant, a frame configured to engage a support surface, a coupler connected to the seat and to the frame, the coupler supporting the seat from the frame for movement relative to the support surface, and an elastic member connected to the seat and to the frame, the elastic member substantially surrounding the seat. In one embodiment, the coupler is elastic and resiliently supports the seat for movement relative to the support surface, the coupler configured to bear a portion of a weight of an infant placed in the seat. The coupler may be an elongate member that is coupled to the frame at a plurality of locations and to the seat at a plurality of locations.

In an alternative embodiment, the infant support structure includes a limit mechanism connected to the frame and to the seat, the limit mechanism configured to limit the extent of movement of the seat relative to the support surface. The limit mechanism may also include a flexible material. In different implementations, the coupler is disposed beneath the elastic member and the frame is collapsible.

In one embodiment, the infant support structure includes a frame that movably supports a seat for a child. The frame rests on a support surface, such as the ground or a floor, and one or more elastic members are connected between the frame and the seat. In one implementation, the seat has an unloaded mode and a loaded mode. In the unloaded mode, the seat is in a rest or unbiased position when no child is in the seat. In this position, the seat is suspended above the support surface in a generally stable position. In the loaded mode, the seat is loaded by the weight of a child and when the child moves, the seat moves up and down relative to the rest position.

In one embodiment, the infant support structure includes a limit member or mechanism that is coupled to the seat and to the frame. The limit member is configured to limit the range of motion of the seat relative to the frame. Accordingly, the movement of the limit member in any direction is limited by the limit member. In one embodiment, a single limit member is used. In other embodiments, more than one limit member is used. The limit member may be a single piece of material that extends substantially around the seat. Alternatively, the limit member may be short members such as straps that are spaced apart around the perimeter of the seat.

As an infant or child in the infant support structure moves, such as by bouncing up and down or side-to-side, motion is imparted to the resilient or elastic member or portion as well. When an object is coupled to or placed on the elastic member, motion is imparted to the object accordingly.

The present invention also relates to an infant support structure including an upper frame member having an arcuate portion and defining a central area, a seat disposed in the central area and coupled to the upper frame member, and a leg member pivotally coupled to the upper frame member. The leg member is movable between a deployed position extending outwardly from the upper frame member and a folded position adjacent the upper frame member. A support member has a first end movably coupled to the upper frame member and an opposite second end pivotally and slidably coupled to the leg member. The second end of the support member is slidable along the leg member as the leg member is moved between the deployed position and the folded position.

In one embodiment, the leg member and the second end of the support member move relative to each other as the second end slides along the leg member. In one implementation, the second end of the support member is releasably lockable in a predetermined position along the leg member. The leg member is releasably locked in the deployed position when the second end is releasably locked in the predetermined position.

In one embodiment, the leg member rotates within the second end of the support member as the second end slides along the leg member. In one implementation, the first end of the support member is rotatably coupled to the upper frame member.

In one embodiment, the leg member is a first leg member. The infant support structure further comprises a second leg member pivotally coupled to the frame member and movable between a deployed position extending outwardly from the frame member and a folded position adjacent the frame member. In one implementation, the first leg member and/or the second leg member has a substantially U-shaped configuration. In another implementation, the first leg member pivots about a first pivot point relative to the frame member, and the second leg member pivots about a second pivot point relative to the frame member. In one embodiment, the first pivot point and the second pivot point are spaced about the frame member by about 180°.

The present invention also relates to an infant support structure including a frame member defining a central area, a seat disposed in the central area and movably coupled to the frame member, and a leg member. The leg member has an arcuate portion pivotally coupled to the frame member and opposing ends. The ends of the leg member are movable between a deployed position extending outwardly from the frame member and a folded position adjacent the frame member.

In one embodiment, the infant support structure further includes a support member having a first end rotatably coupled to the frame member and an opposite second end pivotally and slidably coupled to the leg member. The second end is slidable toward and away from a pivot point about which the leg member and frame member pivot as the leg member is moved between its deployed position and its folded position.

In one embodiment, the seat is coupled to the frame member via a resilient member. The seat is movable toward and away from a plane in which the frame member lies as the resilient member extends and contracts.

The present invention is also directed to an infant support structure including a frame member having an upper portion defining a central area, a seat disposed in the central area and coupled to the upper portion of the frame member, and a flexible member extending between the upper portion of the frame member and the seat. An entertainment element is coupled to one of the upper portion of the frame member or the flexible member or the seat. The entertainment element is engageable with the flexible member and movable upon movement of the resilient member. In one implementation, the flexible member substantially surrounds the seat.

In one embodiment, the upper portion of the frame member includes a support member defining the central area. The flexible member and the seat are located in the central area.

In one embodiment, the upper portion includes a toy bar coupled to the support member. The toy bar extends upwardly relative to the flexible member. The entertainment element is coupled to the toy bar. In one implementation, the toy bar is pivotally coupled to the support member and movable between an extended position extending upwardly relative to the flexible member and a retracted position adjacent the flexible member.

In one embodiment, the entertainment element includes a first portion connected to the upper portion of the frame member and a second portion coupled to the flexible member.

BRIEF DESCRIPTION OF THE DRAWINGS

Like reference numerals have been used to identify like elements throughout this disclosure.

DETAILED DESCRIPTION OF THE INVENTION

The term "infant support structure" and "support structure" may be used interchangeably herein to refer to a structure that can be configured to hold and support a child or infant. The terms "infant" and "child" may be used interchangeably herein. The terms "seat" and "seat portion" may be used interchangeably herein to refer to the portion of the infant support structure that holds the child. While much of the discussion herein relates to a support structure for use for an infant or child, the concept of a support structure with a frame, a seat portion, and an elastic member is applicable to persons other than infants or children.

Figure 1:
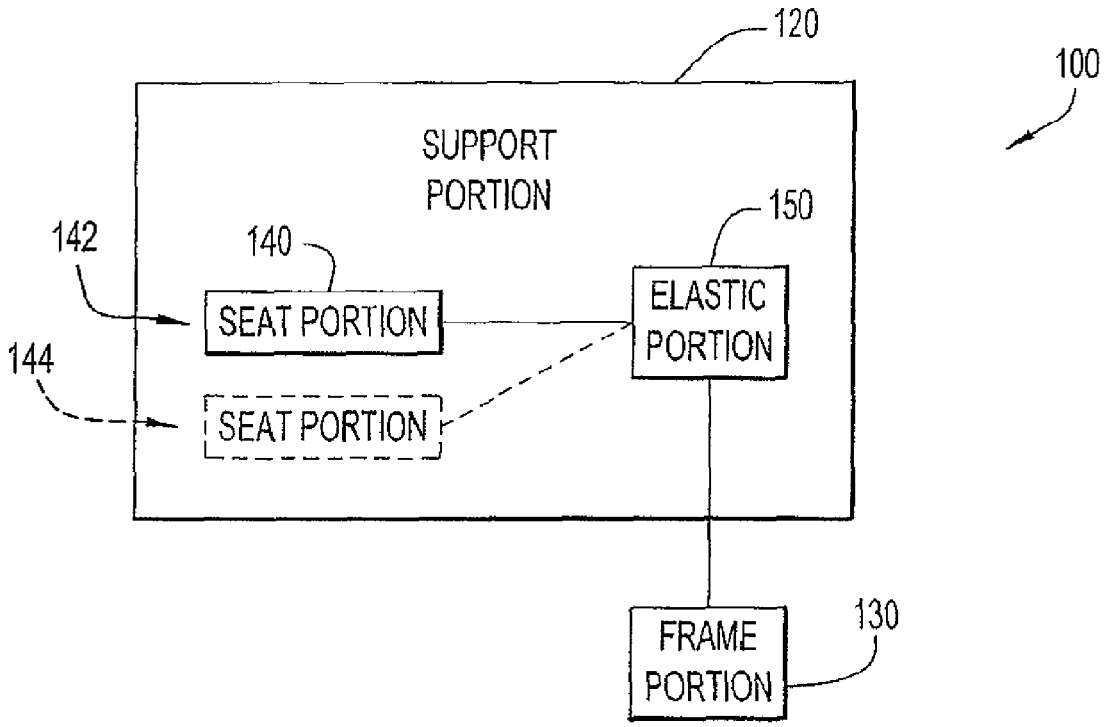
FIG. 1 illustrates a schematic block diagram of an embodiment of an infant support structure according to the invention.

FIG. 1 shows a schematic block diagram illustrating an embodiment of an infant support structure. In this embodiment, the infant support structure 100 includes a support portion or support member 120 and a frame portion or frame member 130. The frame portion 130 may be referred to alternatively as a frame. The frame portion 130 is configured to be placed and supported on a support surface (e.g., a floor or the ground). The seat portion 140 is configured to receive and securely support a child therein.

As shown in FIG. 1, the support portion 120 includes a seat or seat portion 140 and an elastic portion 150. While only one elastic portion 150 is illustrated in FIG. 1, in different embodiments, the infant support structure 100 may include more than one elastic portion 150. The elastic portion 150 is connected to the frame portion 130 and to the seat portion 140 so that the elastic portion 150 supports the seat portion 140 from the frame 130. The seat portion 140 is suspended above a support surface by the elastic portion 150. Accordingly, the seat portion 140 can move relative to the support surface and to the frame 130.

The seat portion 140 has an unloaded, rest position 142 when no child is placed in the seat portion 140. In this position 142, the seat portion 140 is suspended at a particular distance above the support surface. When the seat portion 140 is loaded, such as when a child is placed in seat portion 140, the seat portion 140 is displaced from the rest position 142 to a lower position 144. The elastic portion 150 is resilient and supports the seat portion 140 for movement above and below the rest position 142.

Figure 2:
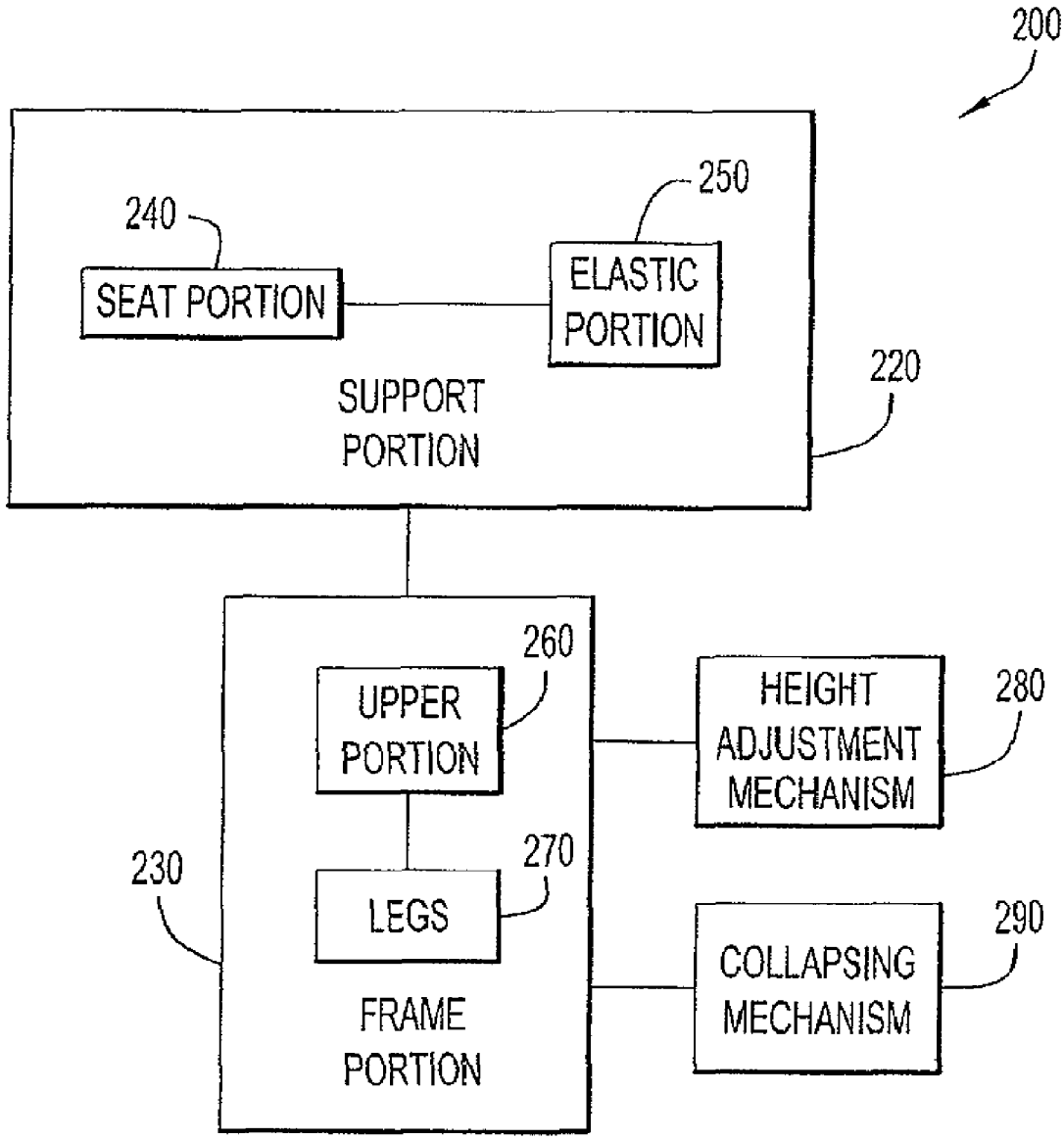
FIG. 2 illustrates a schematic block diagram of an alternative embodiment of an infant support structure according to the invention.

FIG. 2 shows a schematic block diagram of an alternative embodiment of an infant support structure. In this embodiment, the infant support structure 200 includes a support portion 220 and a frame portion 230. The support portion 220 includes a seat portion 240 and an elastic portion 250 coupled to the seat portion 240.

The frame portion 230 includes an upper portion 260 and several legs 270 coupled to the upper portion 260. The legs 270 are configured to engage a support surface, such as a floor or the ground, and to support the upper portion 260. One or more of the legs 270 may include a height adjust mechanism 280 that can be manipulated by a parent or caregiver to adjust the height of the upper portion 260 relative to the support surface. The height adjustment mechanism 280 may result in reconfiguring one or more legs 270 to position the upper portion 260 at different heights above the support surface. In one implementation, one or more legs 270 may include multiple telescoping parts that are coupled to and slide relative to each other. Alternatively, one or more legs 270 may include multiple parts that are connected to each other via threads to facilitate the adjustment of the height of upper portion 260. In addition, the frame portion 230 may include a collapsing mechanism 290 that can be used to maintain the frame portion 230 in a deployed or use configuration as desired.

Figure 3:
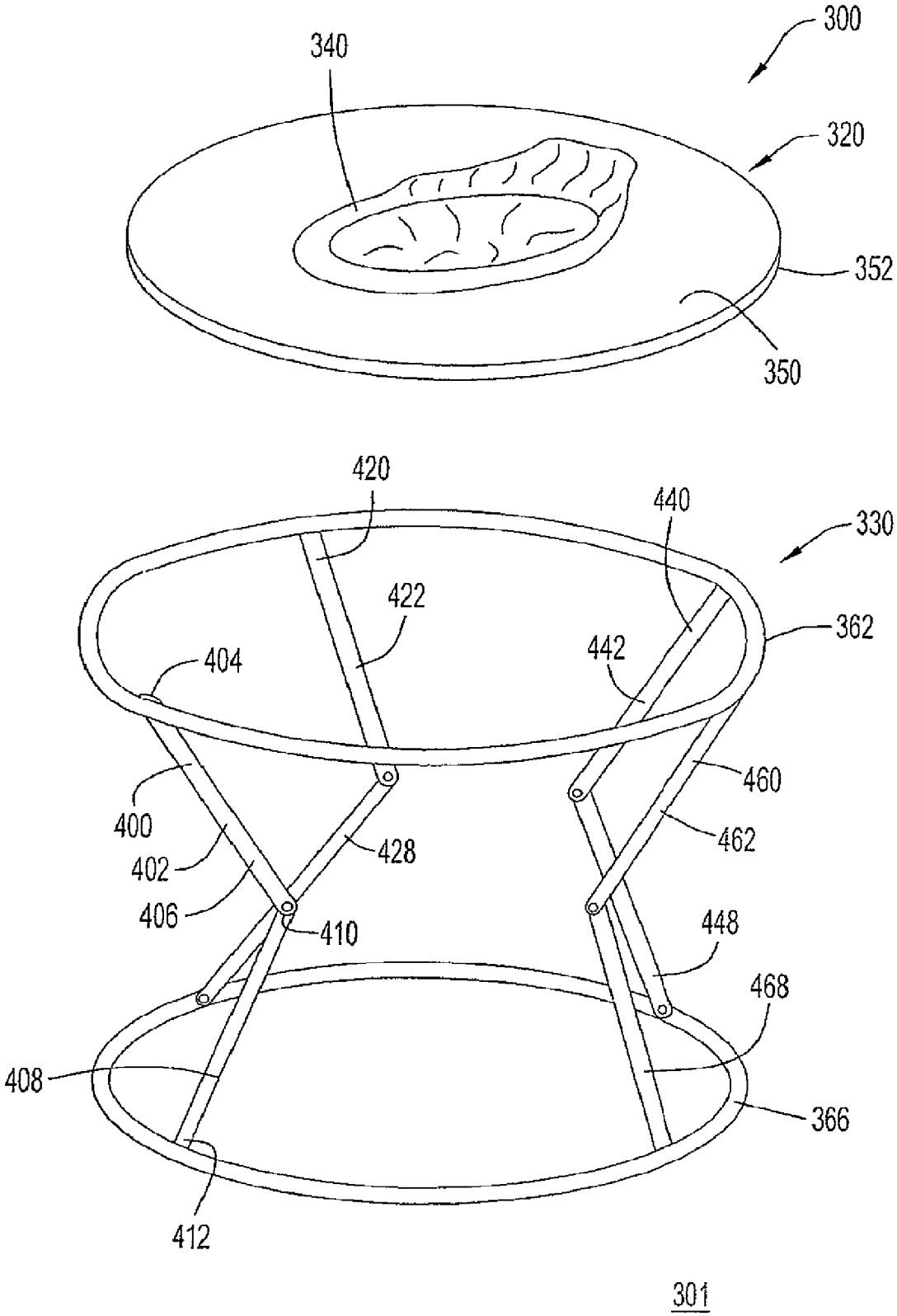
FIG. 3 illustrates a partially exploded view of an embodiment of an infant support structure according to the invention.

Referring to FIG. 3, an embodiment of an infant support structure is illustrated. In this embodiment, the infant support structure 300 includes a support portion or member 320 and a frame portion or member 330. The support portion 320 includes a seat portion 340 and an elastic portion 350. The seat portion 340 is configured to receive and hold an infant or child therein. The elastic portion 350 is connected to the seat portion 340 and to the frame portion 330. In one implementation, the elastic portion 350 may have sufficient strength to support the seat portion 340 from the frame portion 330. In that implementation, a child in the seat portion 340 can bounce up and down and side-to-side via the elastic portion 350.

In one embodiment, the elastic member 350 is made of an elastic material that is sufficiently strong to support the weight of seat portion 340 and an occupant therein. The elastic portion 350 may be a fabric material with elastic properties and may include LYCRA. The elastic portion 350 includes an outer edge or perimeter 352 as shown. The outer edge 352 can be used to engage the frame 330 to couple the elastic portion 350 to the frame 330. The elasticity of the elastic material enables the elastic member 350 to stretch while it allows seat portion 340 to translate vertically. In other embodiments, one or more additional elastic members may be used in additional elastic member 350 to support the seat portion 340 on the frame portion 330.

The frame 330 includes an upper portion 362 that is supported by several legs 400, 420, 440, and 460. The upper portion 362 can be referred to as alternatively an outer member. In the embodiment illustrated in FIG. 3, the frame portion 330 also includes a lower portion 366 that is coupled to the legs 400, 420, 440, and 460. The lower portion 366 is optional in different embodiments based on whether the legs 400, 420, 440, and 460 are sufficiently sturdy and configured to engage the support surface and support the upper portion 362.

In various embodiments, each of the legs 400, 420, 440, and 460 can be a single member or alternatively, formed by coupling together multiple members. In addition, each of the legs 400, 420, 440, and 460 can be fixedly coupled or pivotally coupled to the corresponding one of the upper portion 362 and the lower portion 366. Alternatively, the frame portion 330 may include more or fewer than four legs.

In FIG. 3, each of the legs 400, 420, 440, and 460 is illustrated as including an upper leg member and a lower leg member. As shown, leg 400 includes an upper leg member 402 with opposite ends 404 and 406. Leg 400 also includes a lower leg member 408 with opposite ends 410 and 412. End 404 is coupled to the upper portion 362 via a connector and end 406 is coupled to end 410 of the lower leg member 408 via a connector. In addition, end 412 of the lower leg member 408 is coupled to the lower portion 366 via a connector.

Similarly, leg 420 includes an upper leg member 422 and a lower leg member 428, leg 440 includes an upper leg member 442 and a lower leg member 448, and leg 460 includes an upper leg member 462 and a lower leg member 468. Each of the ends of the legs 420, 440, and 460 is coupled to one of the upper portion 362 and the lower portion 366 by connectors, such as bolts or screws. In one embodiment, the upper leg members and the lower leg member of the legs 400, 420, 440, and 460 are pivotally connected to one of the upper portion 362 and the lower portion 366. In alternative embodiments, the legs 400, 420, 440, and 460 may be formed using a single member that has either a bent configuration or a substantially straight configuration.

In one implementation, the support structure 320 is connected to frame member 330 by fastening the peripheral portion or edge 352 of elastic member 350 to the upper portion 362. When assembled, the upper portion 362 suspends the seat portion 340 of support structure 320 above the support surface 301.

Figure 4:
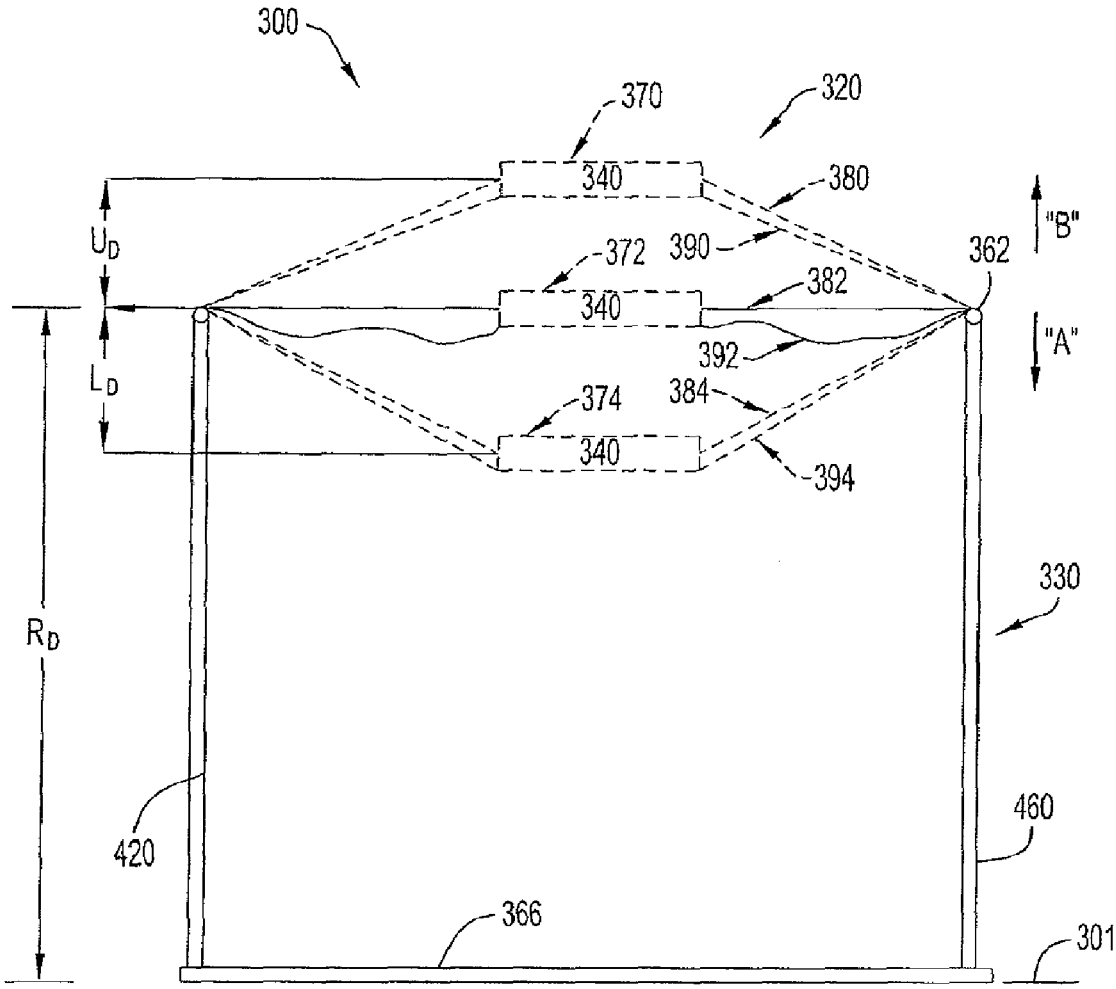
FIG. 4 illustrates a side view of the infant support structure illustrated in FIG. 3, showing the seat portion in different positions.

Referring to FIG. 4, an embodiment of the infant support structure 300 is illustrated showing different positions of the seat portion 340. The infant support structure 300 includes a limit member 360 that limits the range of motion of the seat portion 340. The limit member 360 also suspends the seat portion 340 from the frame portion 330. Depending on the particular position of the seat portion 340, the elastic member 350 and the limit member 360 both suspend the seat portion 340.

In one embodiment, the limit member 360 extends around the perimeter of the seat portion 340. For example, the limit member 360 may be a nylon or TYVEK material, such as a plastic tarp. In an alternative embodiment, the limit member 360 may be one or more elongate members, such as nylon or plastic straps. The multiple straps can be placed around the seat portion 340. In yet another embodiment, the tarp-like material can be placed around the seat 340 and be used with limiting straps spaced around the perimeter of the seat 340.

Referring to FIG. 4, as a child bounces in the seat portion 340 above the support surface 301, the seat portion 340 moves between an upper position 370, a rest position 372, and a lower position 374. As shown, each of the positions 370, 372, and 374 corresponds respectively to elastic member positions 380, 382, and 384 and limit member positions 390, 392, and 394. Seat portion 340 remains in its position 372, which is an unloaded, rest position, when the elastic member 350 is in its position 382 and the limit member 360 is in its position 392. When a child is placed in the seat portion 340, the seat portion 340 moves downwardly along the direction of arrow "A" to its fully loaded position 374 and the elastic member 350 and the limit member 360 are in their lower positions 384 and 394, respectively.

The movement of the seat portion 340 in an upward direction along the direction of arrow "B" is limited to upper position 370 by the limit member 360. In addition, the elastic member 350 may also limit the vertical movement of the seat portion 340. When the seat portion 340 is in its upper position 370, the elastic member 350 and the limit member 360 are in their upper positions 380 and 390. In the upper position 370, the seat portion 340 is upwardly loaded by upward recoil from elastic member 350 and/or from the child's jumping upward off of support surface 301.

As previously described, limit member 360 is connected between seat portion 340 and frame member 330. In seat position 372, the elastic member 350 and limit member 360 support the seat portion 340 above the support surface 301 and the lower portion 366 at a distance designated by distance $R_D$. The limit member 360 limits the downward distance that seat portion 340 can travel relative to rest distance $R_D$ and upper portion 362, this downward distance being illustrated as lower distance $L_D$. In the opposite direction, the limit member 360 limits the upward distance seat portion 340 can travel relative to rest distance $R_D$, and this upward distance is illustrated as upper distance $U_D$. In one embodiment, the lower distance $L_D$ and the upper distance $U_D$ can be approximately four inches. The limit member 360 limits movement of the seat portion 340 to a distance of $R_D-L_D$ from the support surface 301. In the opposite direction, the limit member 360 limits movement of the seat portion 340 to a distance equal to $R_D+U_D$ from the support surface 301.

The limit member 360 can be implemented in several different ways. For example, the limit member 360 is shown in FIG. 4 as being relatively slack in its rest position 392, but as being taught to absorb load and limit travel in its upper position 390 and its lower position 394. In one embodiment, the limit member 360 can be formed from an inelastic material. Alternatively, it can be formed from an elastic material member that substantially reaches its elastic limit at positions 390 and 394.

In one embodiment, the limit member 360 can also be connected between seat portion 340 and upper portion 362 without much slack. This arrangement can be implemented by forming the limit member 360 from an elastic material that stretches and contracts to accommodate various seat positions. As in the case of a slack limit member 360, a non-slack limit member would also reach its elastic limit at positions 390 and 394 and limit the travel of seat portion 340. Limiting the vertical travel of seat portion 340 prevents a child from operating the infant support structure 300 beyond desired seat position limits.

Figure 5:
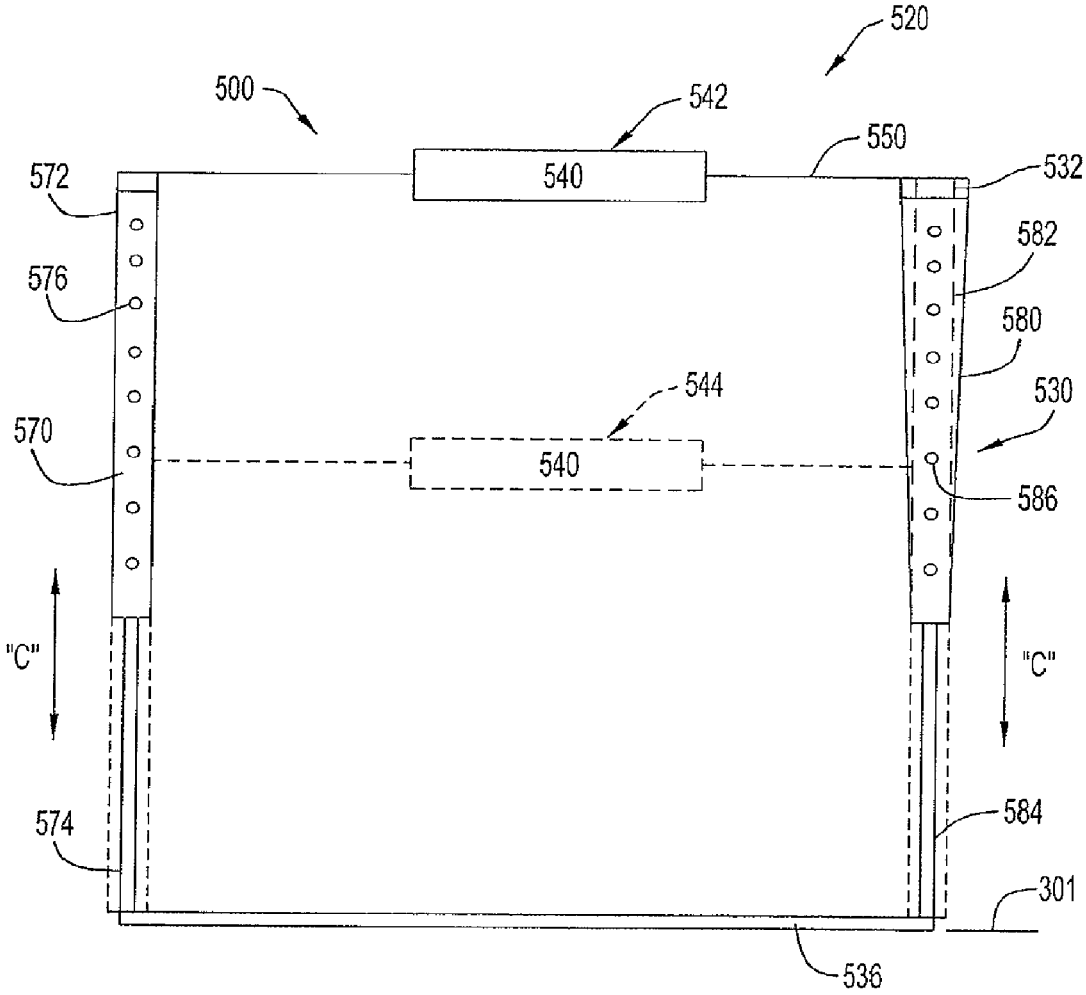
FIG. 5 illustrates a side view of an alternative embodiment of the infant support structure illustrated in FIG. 3, showing the seat portion in different positions.

FIG. 5 illustrates another embodiment of an infant support structure. In this embodiment, the infant support structure 500 includes a support portion 520 and a frame or frame portion 530 that is configured to engage a support surface 301. The support portion 520 includes a seat portion 540 and an elastic member or portion 550 that supports the seat portion 540 from the frame 530. The frame 530 includes an upper member 532 to which the elastic portion 550 can be coupled and a lower member 536. The frame 530 includes legs 570 and 580. In this embodiment, the legs 570 and 580 are coupled to the upper frame member 562 and a lower frame member 566. While two legs are illustrated in FIG. 5, in different embodiments, the quantity of legs of the frame 530 can vary.

As shown in FIG. 5, leg 570 includes an upper leg member 572 and a lower leg member 574. Lower leg member 574 slides telescopically within upper leg member 572 along the direction of arrow "C," which enables the length of the leg 570 to be adjusted. Similarly, leg 580 includes an upper leg member 582 and a lower leg member 584. Lower leg member 584 slides telescopically within upper leg member 582 along the direction of arrow "C," which enables the length of leg 580 to be adjusted. Each of the upper leg members 572 and 582 includes several openings 576 and 586, respectively, that can be used to secure the length of the legs 570 and 580.

When the legs 570 and 580 are locked in particular length positions, the upper member 562 is supported at different corresponding heights above support surface 301. As a result, support structure 520, and thus, seat portion 540 are also supported at different heights above support surface 301. Referring to FIG. 5, different upper and lower positions 542 and 544 of the seat portion 540 are illustrated. The height adjustment features of the legs 570 and 580 enable the seat portion 540 to be placed into various positions relative to the support surface 301. In various embodiments, the quantity of heights at which the seat portion 540 can be placed can vary.

Figure 6:
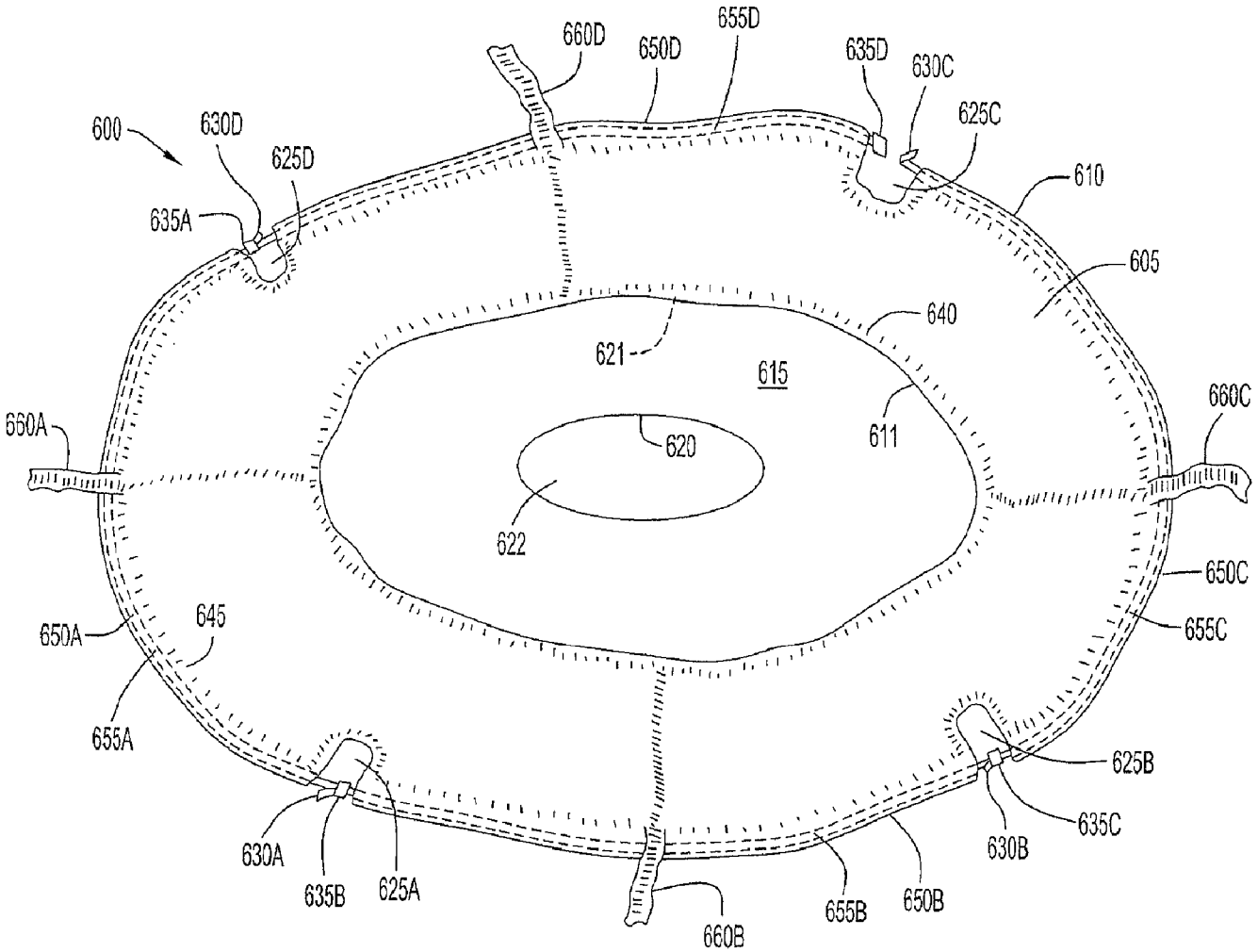
FIG. 6 illustrates a top perspective view of the elastic member of the infant support structure illustrated in FIG. 3.

Referring to FIG. 6, an embodiment of an elastic portion of an infant support structure is illustrated. In this embodiment, the elastic portion 600 includes an outer fabric member 605 and an inner fabric member 615. The outer fabric member 605 is connected to the inner fabric member 615 around the perimeter of the inner fabric member 615. The outer fabric member 605 and the inner fabric member 615 can be sewn together, such as by stitching 640. The outer fabric member 605 has an outer edge 610 and an inner edge 611 and the inner fabric member 615 includes an inner edge 620 and an outer edge 621. The inner edge 620 of the inner fabric member 615 defines a seat opening 622 therethrough. In this embodiment, the outer edge 621 of the inner fabric member 615 and the inner edge 611 of the outer fabric member 605 are coupled together.

In one embodiment, the outer fabric member 605 is made from a different material than inner fabric member 615. For example, outer fabric member 605 may be made from a material that is less elastic than inner fabric member 615. The more resilient and less elastic outer fabric member has sufficient strength to be used as the portion of the outer fabric member 605 that is coupled or mounted to the frame. The inner fabric member 615 may be more elastic to provide a greater bounce and springiness near an infant placed in the seat portion. The bouncing characteristics results in motion of objects placed on or coupled to the inner fabric member 615 as a child bounces in the seat portion.

Figure 12:
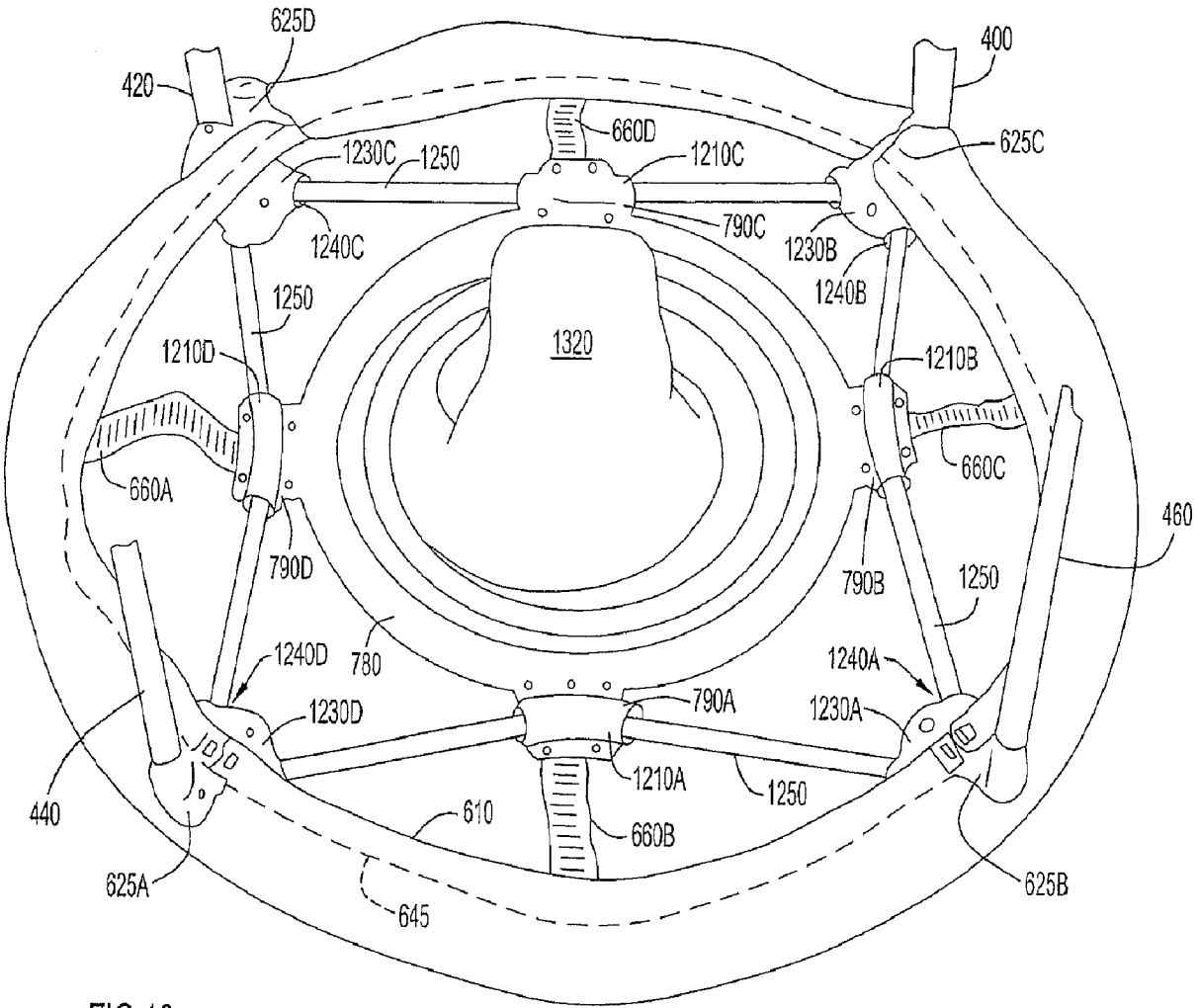
FIG. 12 illustrates a bottom perspective view of an embodiment of an infant support structure according to the invention.

The outer edge 610 includes an outer edge stitch 645 which defines spaced apart channels 650A-D that are located around the perimeter of the edge 610. The outer edge 610 also includes multiple cutouts 625A-D as shown in FIG. 6. In addition, connector straps 655A-D pass respectively through each outer edge channel 650A-D. The ends of connector straps 655A-D terminate in respective cutouts 625A-D and each connector strap 655A-D has a hook end 630A-D and an opposite loop end 635A-D. A hook end from each connector strap and a loop end from an adjacent connector strap are respectively connected to form a continuous connector strap around the perimeter of portion 600. The respective connections formed by the hook ends 630A-D and loop ends 635A-D are exposed in cutouts 625A-D. The continuous connector strap secures the elastic member to the frame by capturing and maintaining the legs of the frame in the cutouts 625A-D. FIG. 6 also shows limit members 660A-D coupled to outer edge 610 and extending away from elastic member 600. The limit members 660A-D are secured to the seat portion as illustrated in FIG. 12 and described below.

Figure 7:
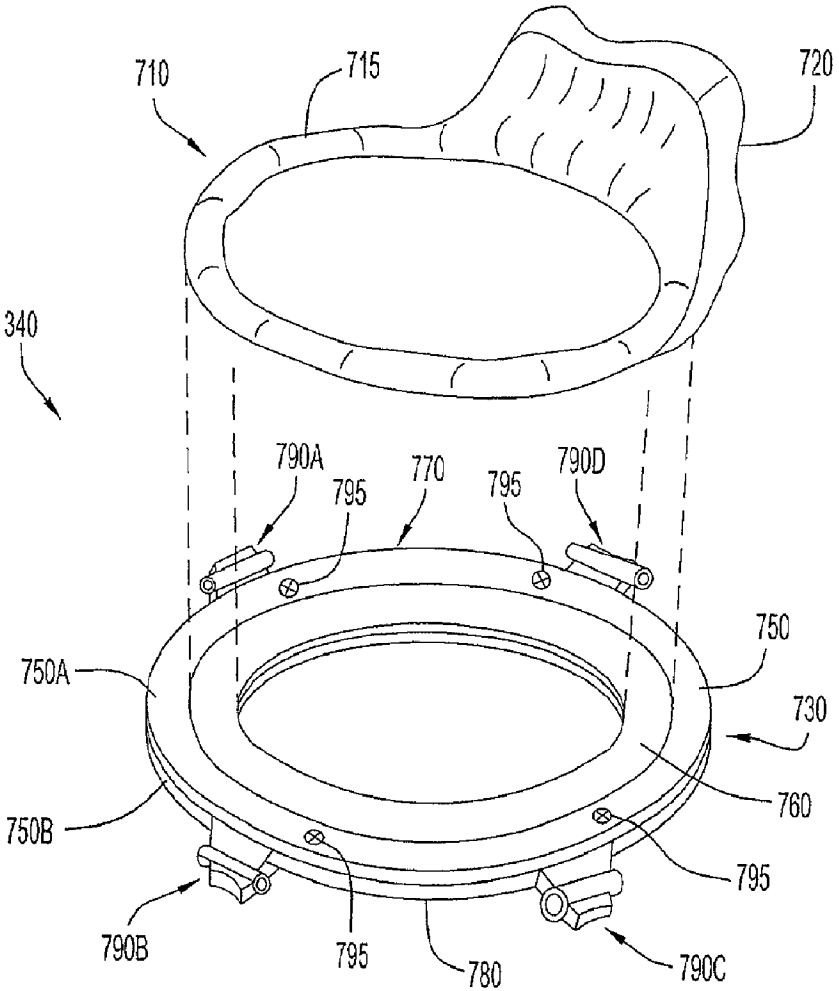
FIG. 7 illustrates a partially exploded view of the seat portion of the infant support structure illustrated in FIG. 3.
Figure 8:
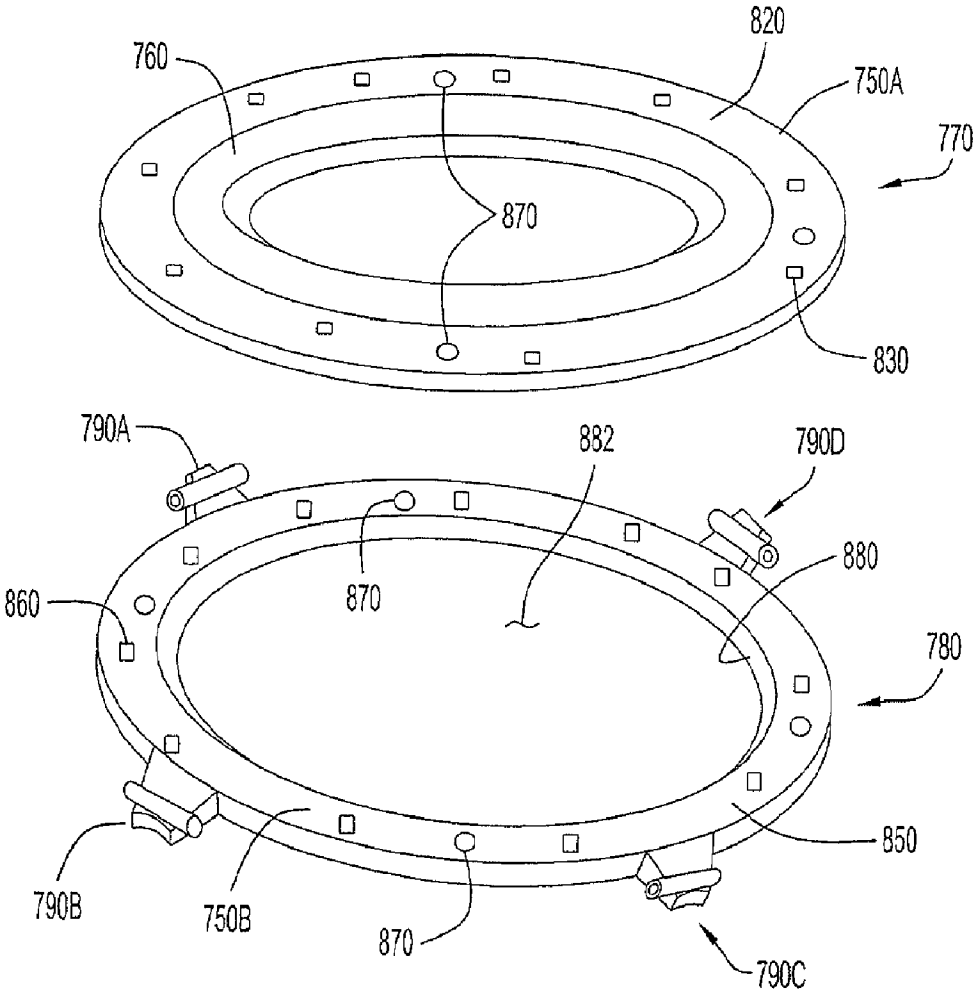
FIG. 8 illustrates an exploded perspective view of components of the seat portion illustrated in FIG. 7.
Figure 9:
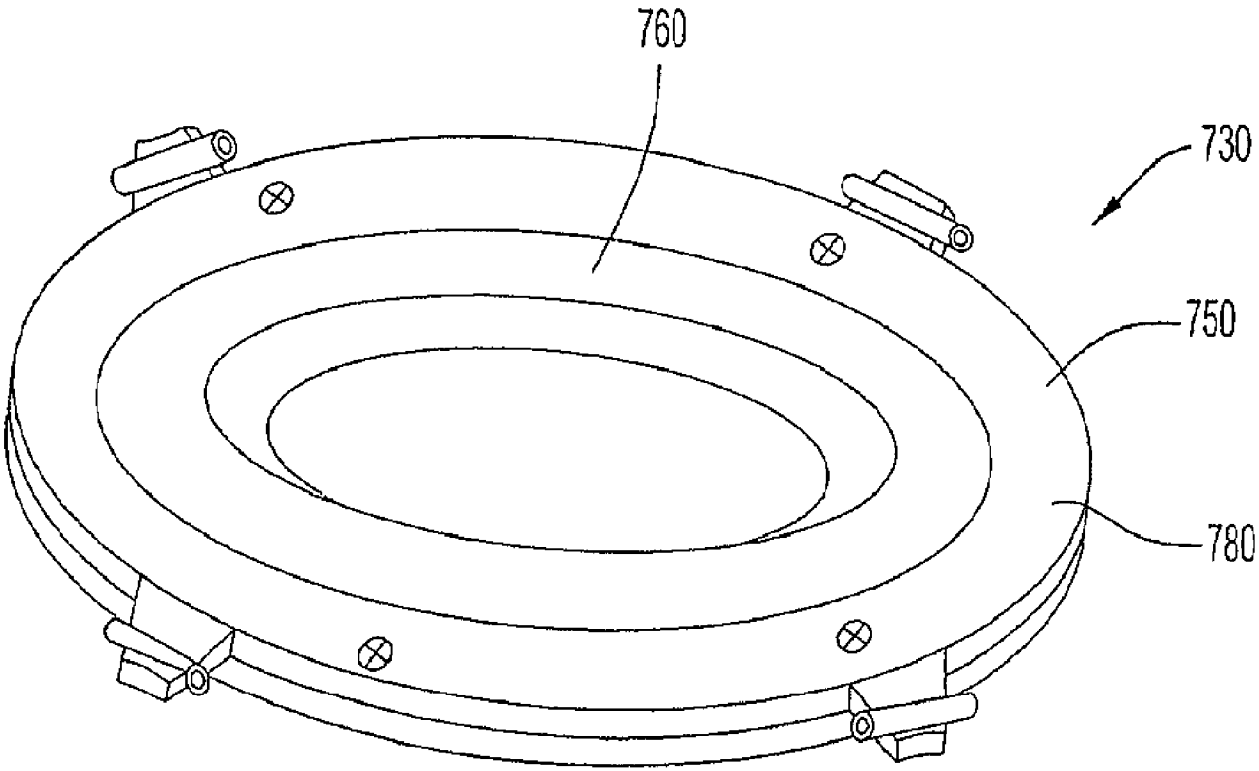
FIG. 9 illustrates a bottom perspective view of the components illustrated in FIG. 8.

FIGS. 7-9 shows an embodiment of a seat portion. FIG. 7 illustrates a partially exploded top perspective view of seat portion 340. Seat portion 340 includes a seat cushion 710 that is supported by a cushion support 730. In one implementation, the seat cushion 710 is made from a resilient material (e.g., resilient foam, or other soft or elastic material) that is formed into a body portion 715 and a back portion 720. The seat cushion 710 provides a comfortable surface for a child placed in seat portion 340. The cushion support 730 is formed from a rigid material (e.g., plastic or other moldable material) and includes an inner rotating member 760 that is rotatably mounted to an outer stationary member 750.

In one embodiment, the cushion support 730 has an upper portion 770 and a lower portion 780. The stationary member 750 includes an upper stationary member 750A on upper portion 770 and a lower stationary member 750B on lower portion 780. Cushion support 730 also includes fasteners or connectors 795 that are used to secure the stationary members 750A and 750B together. Furthermore, the lower portion 780 includes seat connectors 790A-D for connecting the seat portion 340 to the elastic member 350 and as a result, to the frame member 330.

FIG. 8 illustrates an exploded view of cushion support 730 which includes a lower perspective view of the upper seat portion 770 and an upper perspective view of lower seat portion 780. Rotatable member 760 is shown connected to upper stationary member 750A of the upper seat portion 770. In alternative embodiments, rotatable member 760 can instead be connected to lower seat portion 780. The upper stationary member 750A and the lower stationary member 750B also include openings 870 through which fasteners 795 may pass to secure upper and lower stationary portions 750A and 750B together.

As illustrated in FIG. 8, assembling cushion support 730 requires turning over the upper seat portion 770 so that the rotatable member 760 can be placed into the lower opening 882 in the lower seat portion 780 formed by edge 880. The assembled cushion support 730 is illustrated in FIG. 9.

Referring back to FIG. 8, upper stationary member 750A (shown upside down) includes a surface 820 and the lower stationary member 750B includes a surface 850. The surfaces 820 and 850 include fabric grips 830 and 860. The fabric grips 830 and 860 are used in the securing of material (such as a sheet of elastic fabric) in a compressed manner between the surfaces 820 and 850. The fabric grips 830 and 860 can have any shape or configuration, such as projections extending from the surface 820 that enter corresponding openings on surface 850.

Figure 10:
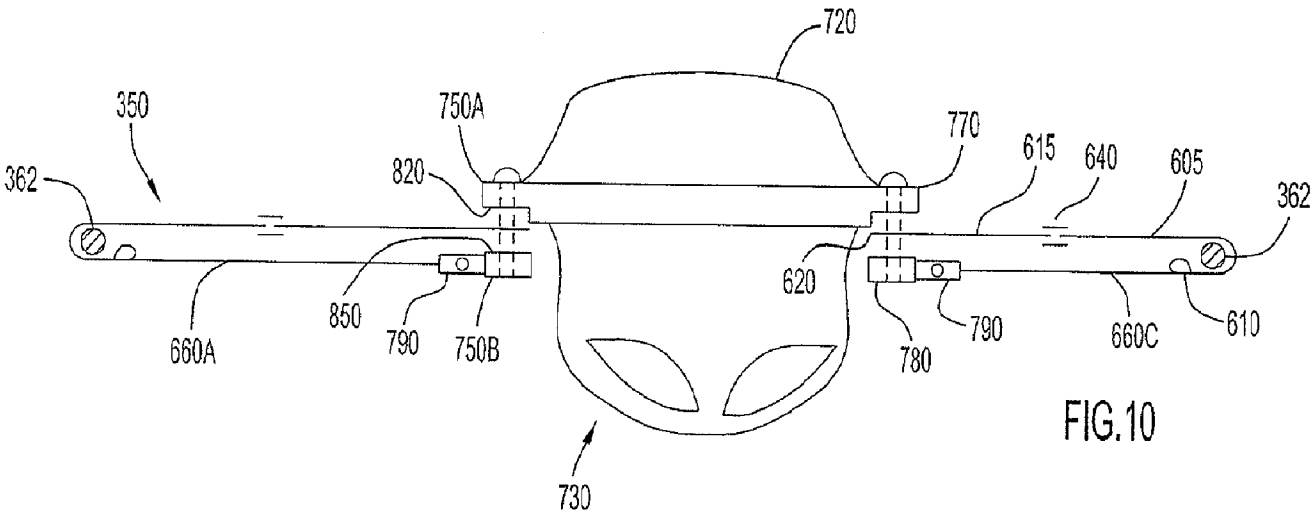
FIGS. 10 and 11 illustrate cross-sectional views of some components of the infant support structure illustrated in FIG. 3 in partially exploded and in assembled views, respectively.
Figure 11:
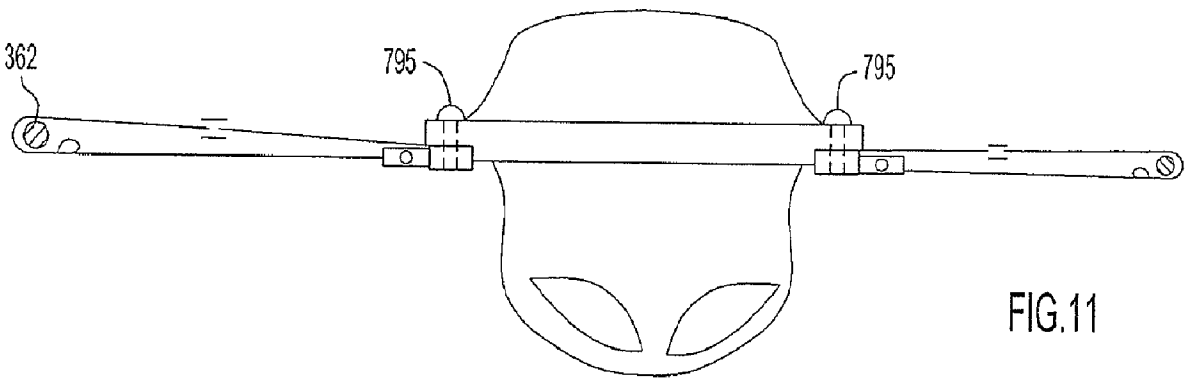

FIGS. 10-12 illustrate various components of the infant support structure 300. Referring to FIG. 10, a simplified cross-sectional view is illustrated showing the cushion support 730 separated into an upper seat portion 770 and a lower seat portion 780. The elastic member 350 is placed so that it extends around the upper portion 362. As shown, the inner fabric member 615 has its inner edge 620 is positioned between surface 820 of the upper stationary member 750A and the surface 850 of the lower stationary member 750B. The outer fabric member 605 is connected to the inner fabric member 615 by stitching 640. The outer edge 610 is wrapped around the upper portion 362 around the perimeter of the upper portion 362 of the frame.

On the underside of elastic member 350, limit members 660A and 660C are connected to seat connectors 790A and 790C, respectively, and to the outer edge 610. The upper seat portion 770 is connected to the lower seat portion 780 by fasteners 795, thereby capturing the inner edge 620 of the elastic member 350 between surfaces 820 and 850. As discussed above, fabric grips 830 and 860 reduce the likelihood that the inner edge 620 separates from between surfaces 820 and 850.

FIG. 12 illustrates a lower perspective view of components of the infant support structure 300, and in particular, the elastic portion 350 and the seat portion 1320. The elastic portion 350 is removably connected to the frame member 330. As previously described, the elastic portion 350 includes several spaced apart cutouts 625A-D. To connect the elastic portion 350 to the frame member 330, the outer edge 610 of the elastic member 350 is wrapped around upper portion 362 and the elastic portion 350 is arranged so that each of the cutouts 625A-D is aligned with one of the legs 400, 420, 440, and 460. The portions defining the cutouts 625A-D are placed around the legs 400, 420, 440, and 460 so that the outer edge 610 is located on the inner sides of the legs 400, 420, 440, and 460 below the upper member 362.

As previously described, hook ends 630A-D are connected to corresponding loops ends 635A-D so that the connector straps 655A-D form a continuous loop or connector strap around the perimeter of the upper portion 362. The continuous connector strap has a smaller diameter than the upper member 362 so that the elastic member 350 cannot be inadvertently removed from the upper member 362, thereby requiring the decoupling of the hooks ends and the loop ends.

Referring to FIG. 12, each of the seat connectors 790A-D includes a support channel 1210A-D formed therethrough. Each of the legs 400, 420, 440, and 460 includes an upper leg connector that is connected to the upper frame member 362 and includes a flexible member support 1230A-D having a support channel 1240A-D formed therein. A flexible or resilient member 1250 (such as an elastic or bungee cord) passes alternately through each of the support channels 1210A-D and each of the support channels 1240A-D as shown, which in some embodiments can resemble a star-like pattern. The resilient member 1250 is an elongate member and forms a suspension mechanism for the infant support structure. In this configuration, the flexible member 1250 resiliently couples the seat portion 340 to the frame portion 330 at several locations on each of the portions 330 and 340. Therefore, when the seat portion 340 moves up and down or side-to-side between different positions, the flexible member 1250 bears at least a portion of the load transferred from seat portion 340 to frame member 330. The limit members 660A-D are attached to the elastic member 350 and the seat connectors 790. As a result, the limit members 660A-D limit the movement of the seat portion 340.

Figure 13:
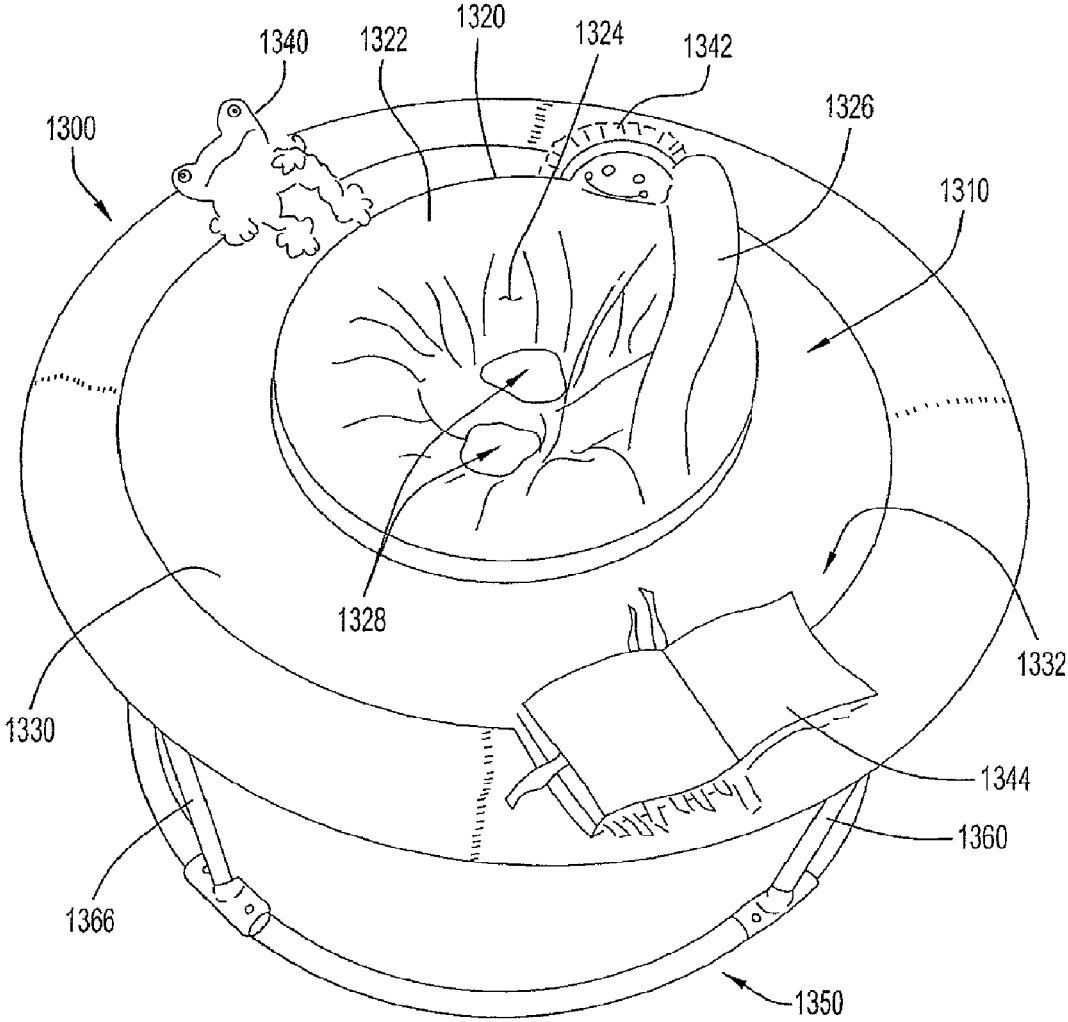
FIG. 13 illustrates a perspective view of the infant support structure illustrated in FIG. 12.

Referring to FIG. 13, a top perspective view of an embodiment of infant support structure is illustrated. In this embodiment, the infant support structure 1300 includes a support portion 1310 and a frame portion 1350. The frame portion 1350 includes several legs. Legs 1360 and 1366 are illustrated. The support portion 1310 includes a seat portion 1320 and a fabric portion 1330. The seat portion 1320 includes a cover 1322, such as a fabric cover, that covers a seat cushion, including the back portion 1326, and forms a seat pocket or receptacle 1324 in which an infant can be placed. The seat pocket 1324 extends downwardly to leg openings 1328 formed in the fabric cover 1322 which are configured for the legs of a child.

As shown, the top or upper surface of the elastic member or portion 1330 is positioned so that it forms an activity surface 1332 in proximity to a child positioned in the seat portion 1320. Various objects 1340, 1342, and 1344, such as toys, can be coupled to or simply placed on the activity surface 1332 within reach of the child. As a child bounces up and down and side-to-side in the seat portion 1320, the vibrations created by the movement of the child are imparted to the objects 1340, 1342, and 1344, which move accordingly and provide sensory stimulation for the child. Thus, the entertainment of the child is enhanced by the fact that the child can move and see the resulting movement of the objects 1340, 1342, and 1344.

Figure 14:
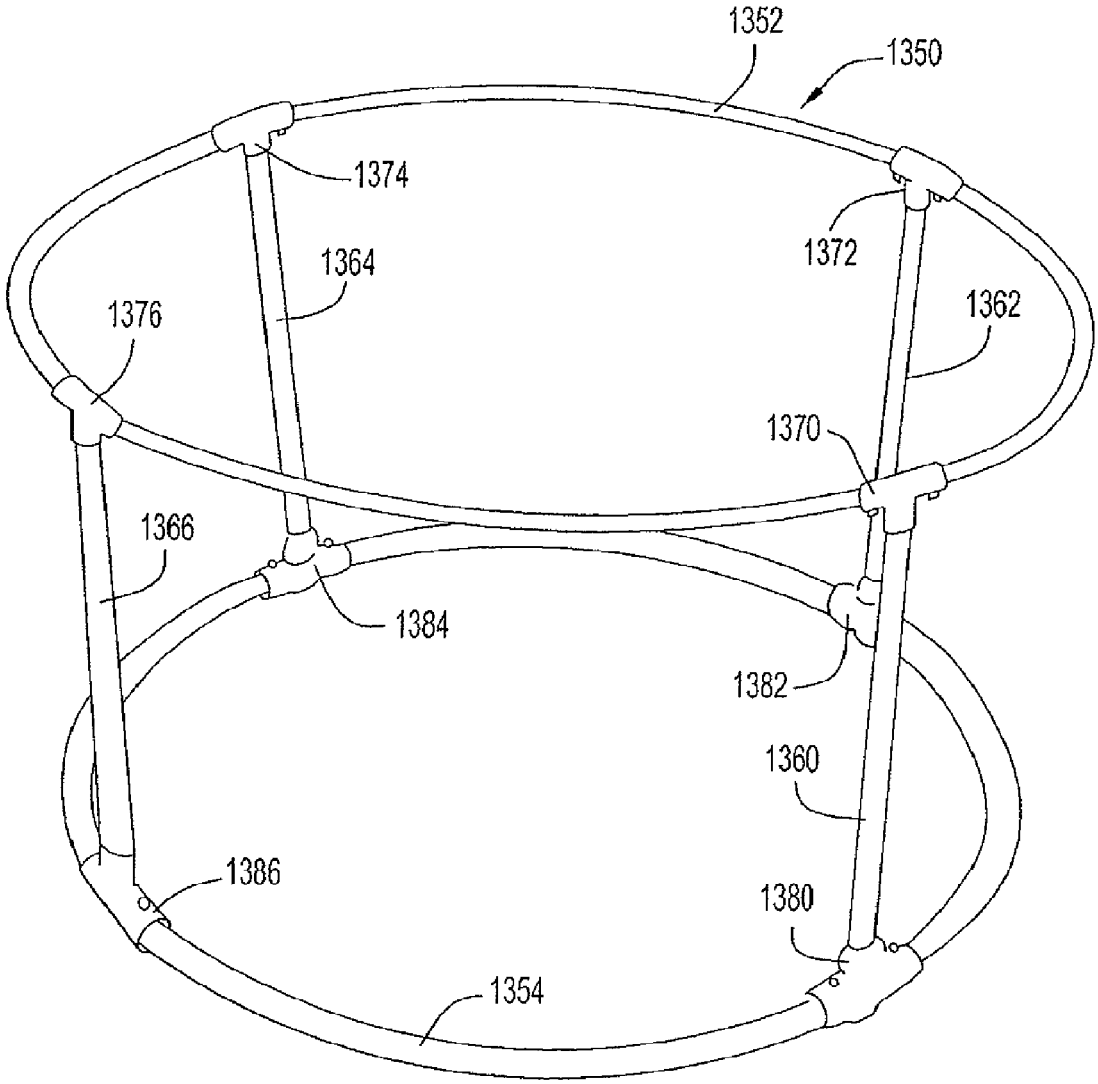
FIGS. 14 and 15 illustrate assembled and exploded perspective views of the frame member of the infant support structure illustrated in FIGS. 12 and 13.
Figure 15:
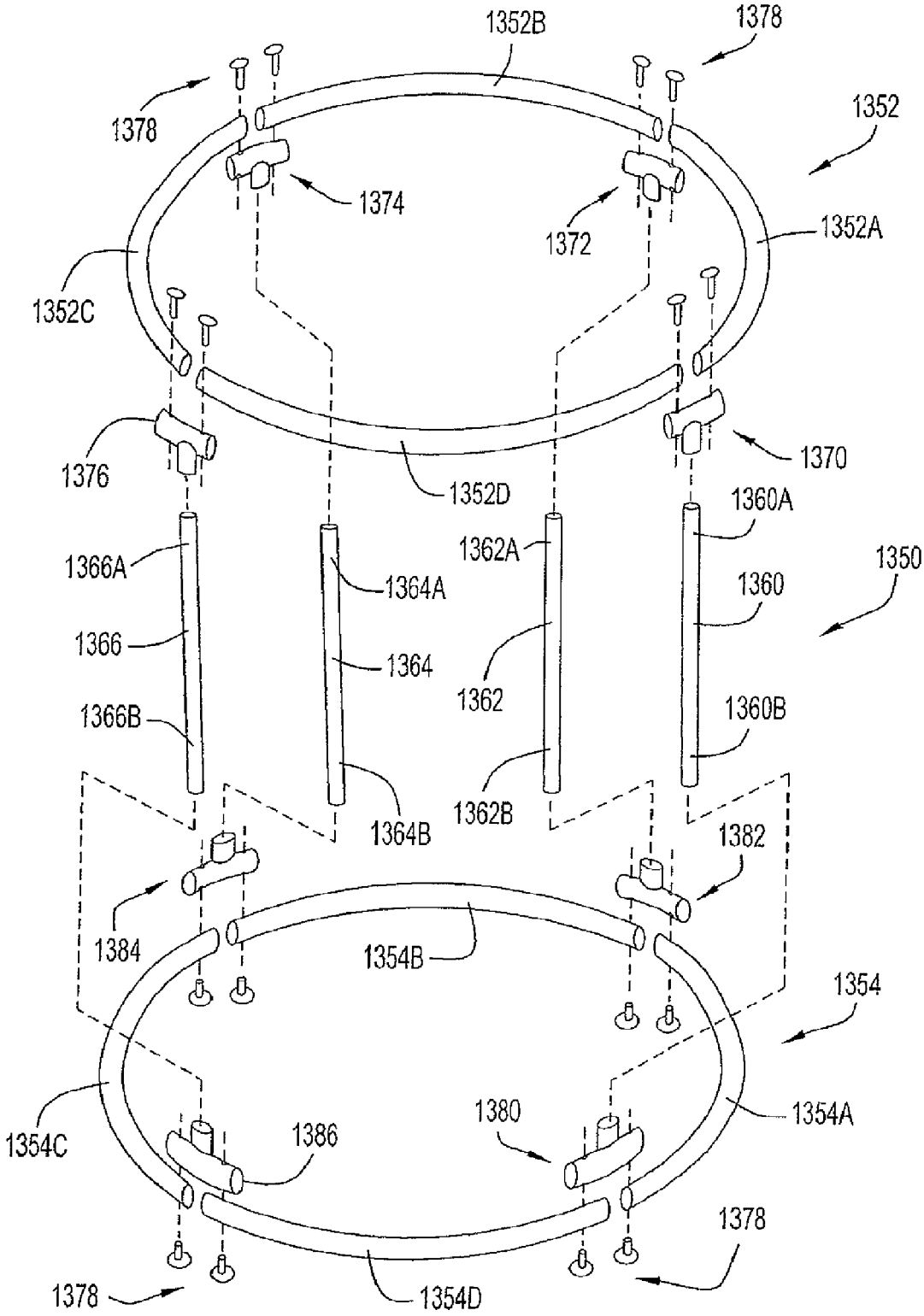

Referring to FIGS. 14 and 15, the frame 1350 of infant support structure 1300 is illustrated. In this embodiment, the frame 1350 includes an upper portion 1352 and a lower portion 1354. In different embodiments, the upper and lower portions 1352 and 1354 can be formed using one or more arcuate members. As shown in FIG. 15, the upper portion 1352 includes several members 1352A-D that collectively form the upper portion 1352. Similarly, the lower portion 1354 includes several members 1354A-D that collectively form the lower portion 1354.

The frame member 1350 includes several legs 1360, 1362, 1364, and 1366 that are coupled to the upper portion 1352 and the lower portion 1354. In particular, the leg upper ends 1360A, 1362A, 1364A, and 1366A are coupled to connectors 1370, 1372, 1374, and 1376, respectively, via a friction fit and/or connectors 1378. Similarly, the leg lower ends 1360B, 1362B, 1364B, and 1366B are coupled to connectors 1380, 1382, 1384, and 1386, respectively, via a friction fit and/or connectors 1378. Alternatively, the legs 1360, 1362, 1364, and 1366 can be threaded to be coupled to the connectors.

Figure 16:
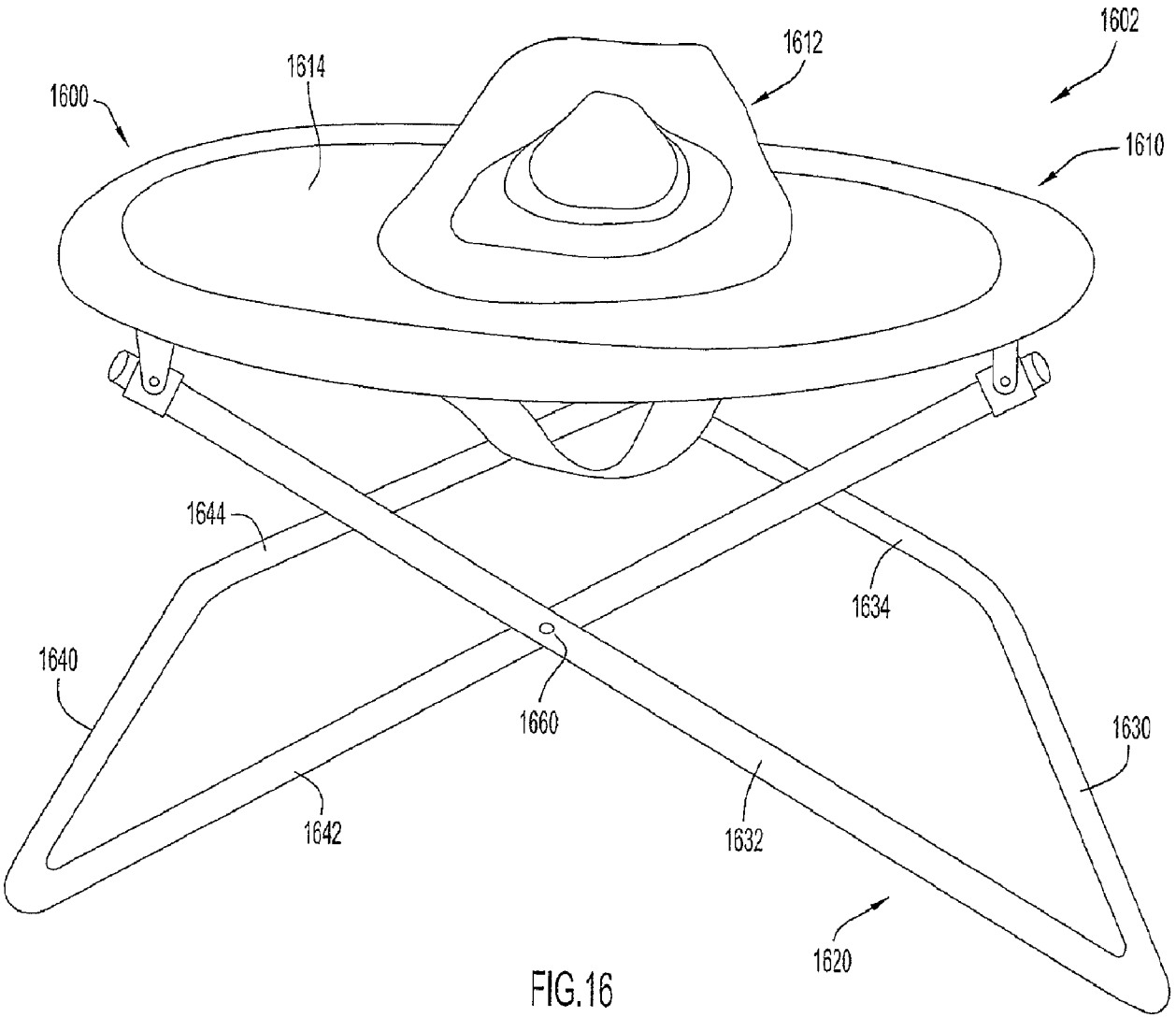
FIG. 16 illustrates a perspective view of an alternative embodiment of an infant support structure according to the invention.
Figure 17:
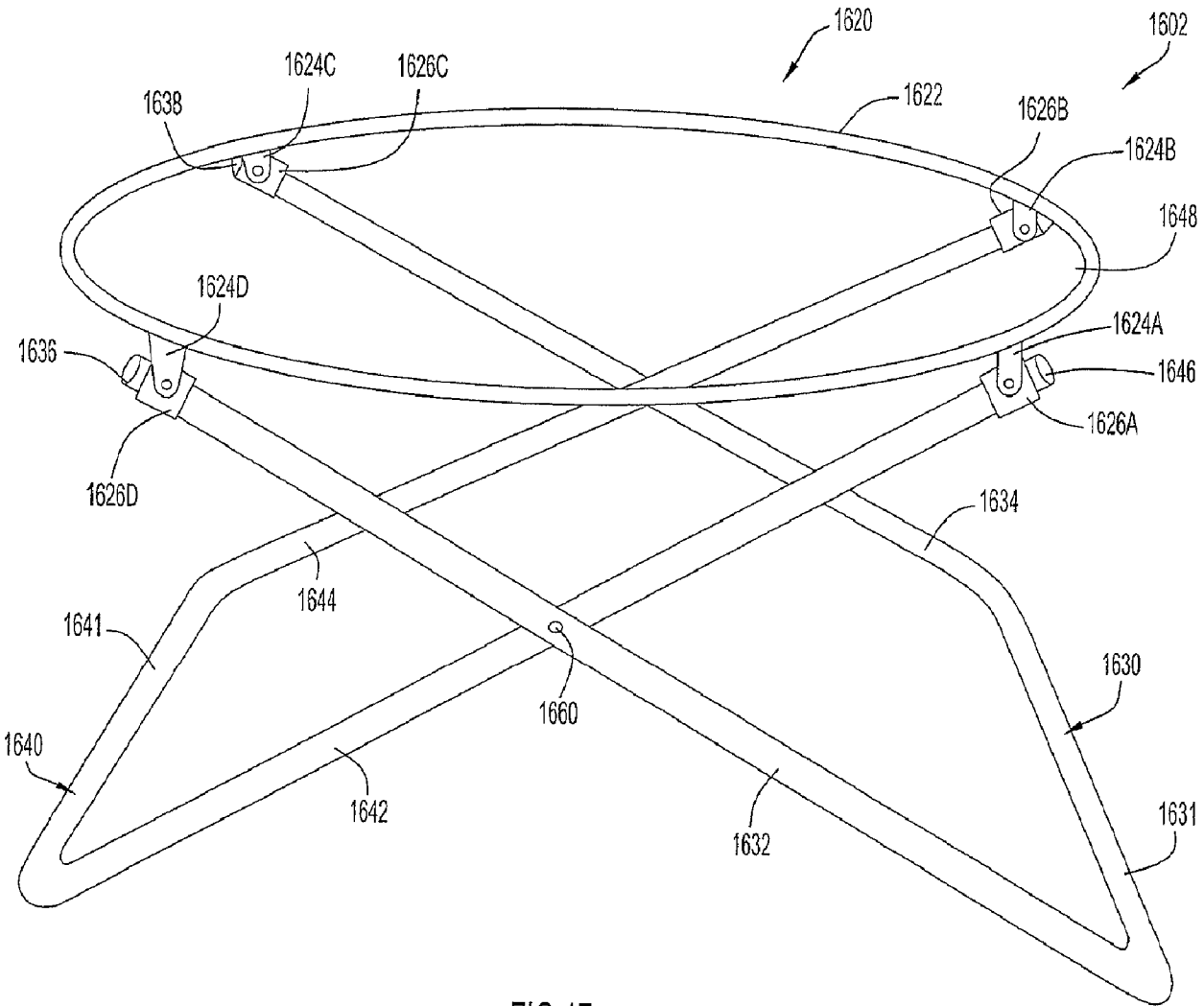
FIG. 17 illustrates a perspective view of the frame member of the infant support structure illustrated in FIG. 16 in a deployed configuration.
Figure 18:
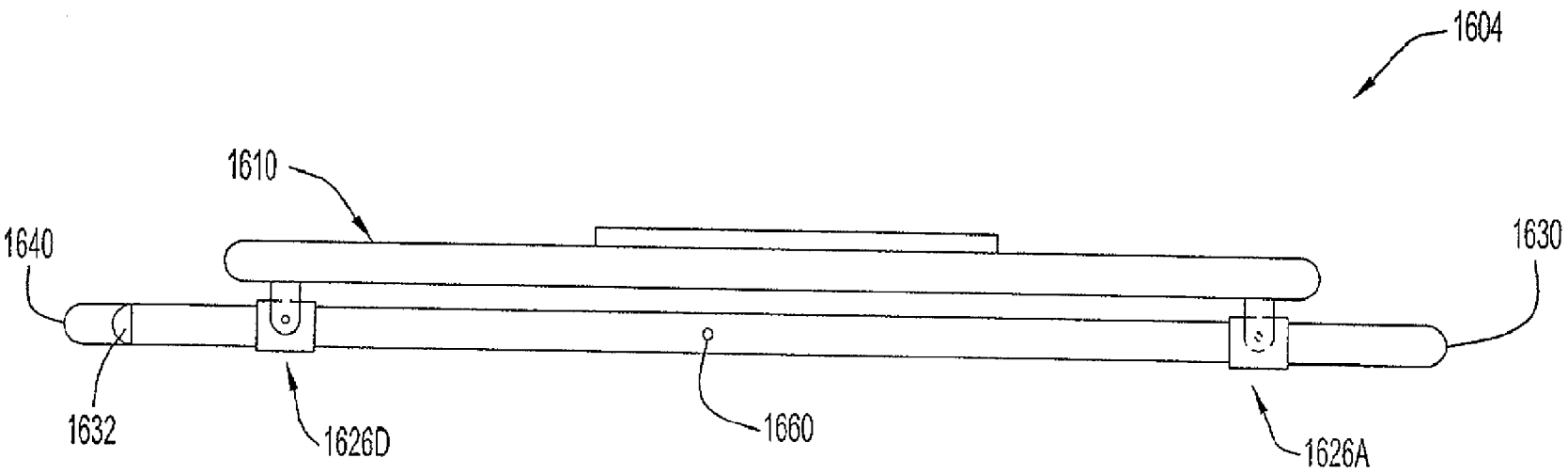
FIG. 18 illustrates a side view of the frame member illustrated in FIG. 17 in a collapsed configuration.

FIGS. 16-18 illustrate another embodiment of an infant support structure. The infant support structure 1600 is illustrated in a deployed configuration 1602 in FIGS. 16 and 17 and in a collapsed configuration 1604 in FIG. 18. The infant support structure 1600 includes a support portion 1610 and a frame portion 1620. The support portion 1610 includes a seat portion 1612 in which an infant can be placed. The support portion 1610 includes an elastic portion 1614 that has elastic properties such that the seat portion 1612 can bounce up and down and move side-to-side relative to the frame portion 1620. The elastic portion 1614 enables a child in the seat portion 1612 to bounce and move in any desired direction and functions as a trampoline-like structure.

The frame portion 1620 includes legs 1630 and 1640 that are pivotally coupled to each other. Leg 1630 is substantially U-shaped with a lower support surface engaging part 1631 and two leg members 1632 and 1634 that have ends 1636 and 1638, respectively. Similarly, leg 1640 is substantially U-shaped with a lower support surface engaging part 1641 and two leg members 1642 and 1644 that have ends 1646 and 1648, respectively. Leg members 1632 and 1642 are coupled together by a connector 1660. Similarly, leg members 1634 and 1644 are coupled together by a connector (not shown).

Referring to FIG. 17, the frame portion 1620 is illustrated with the support portion 1610 removed therefrom. As shown, the legs 1630 and 1640 form a collapsible, generally X-shaped structure when viewed from a side. In one embodiment, each of the legs 1630 and 1640 is slidably coupled to the upper portion 1622 of the frame 1620. The upper portion 1622 includes several mounting components 1624A-D, each of which has a sleeve 1626A-D pivotally coupled thereto.

The leg members 1632, 1634, 1642, and 1644 are inserted into and slidably coupled to sleeves 1626D, 1626C, 1626B, and 1626A, respectively. The upper ends 1636, 1638, 1646, and 1648 of the legs are configured to prevent the separation of the legs 1630 and 1640 from the sleeves. For example, the upper ends 1636, 1638, 1646, and 1648 may be formed with a portion having a diameter greater than that of the sleeves 1626A-D. Alternatively, a separate piece may be coupled to the upper ends 1636, 1638, 1646, and 1648 which may have a larger diameter than that of the sleeves 1626A-D. Accordingly, the frame member 1620 is collapsible by allowing the upper ends 1636, 1638, 1646, and 1648 to slide relative to sleeve connectors 1626A-D until the frame member 1620 is in its collapsed configuration as illustrated in FIG. 18.

Figure 19:
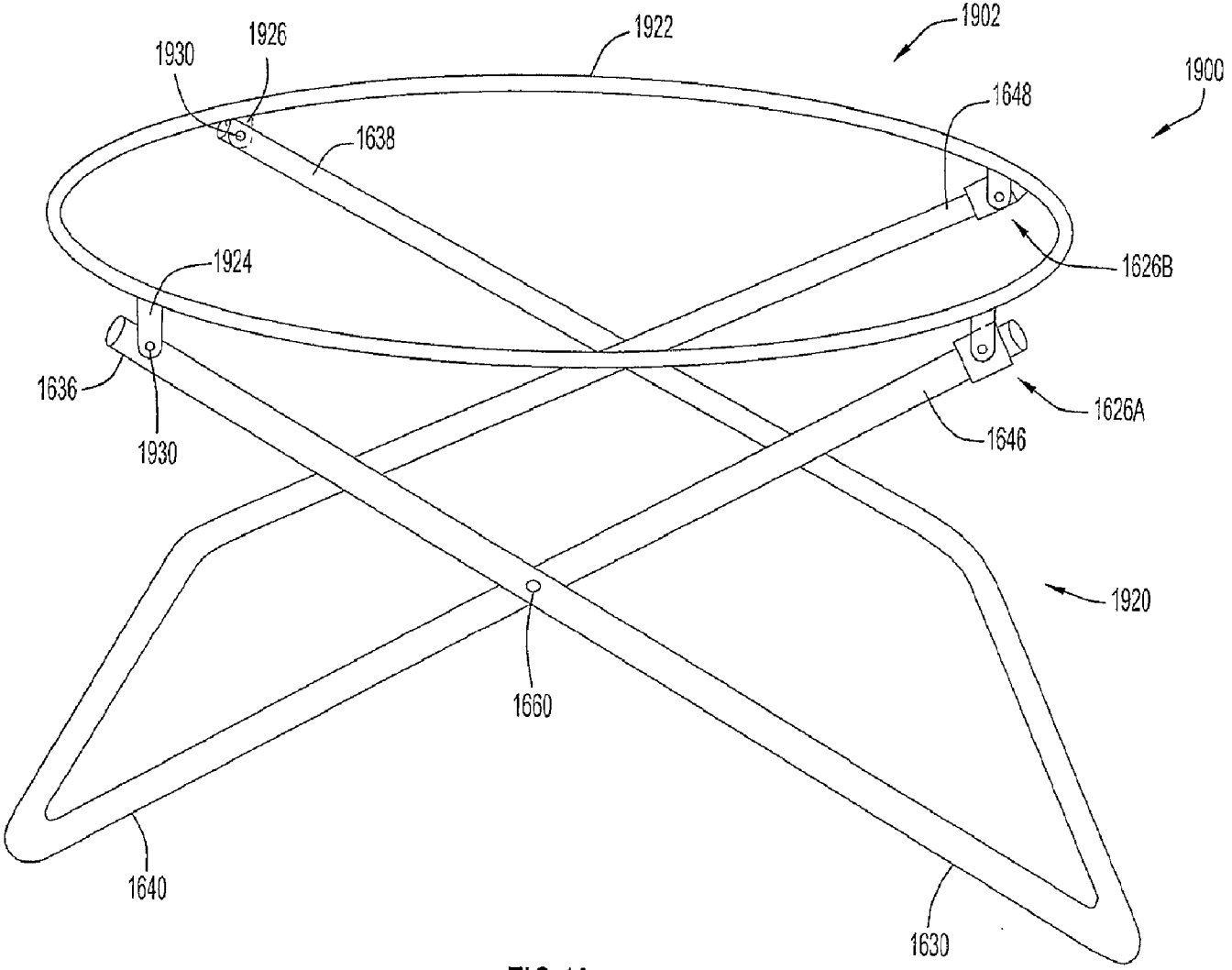
FIG. 19 illustrates a perspective view of an alternative embodiment of the frame member according to the invention.
Figure 20:
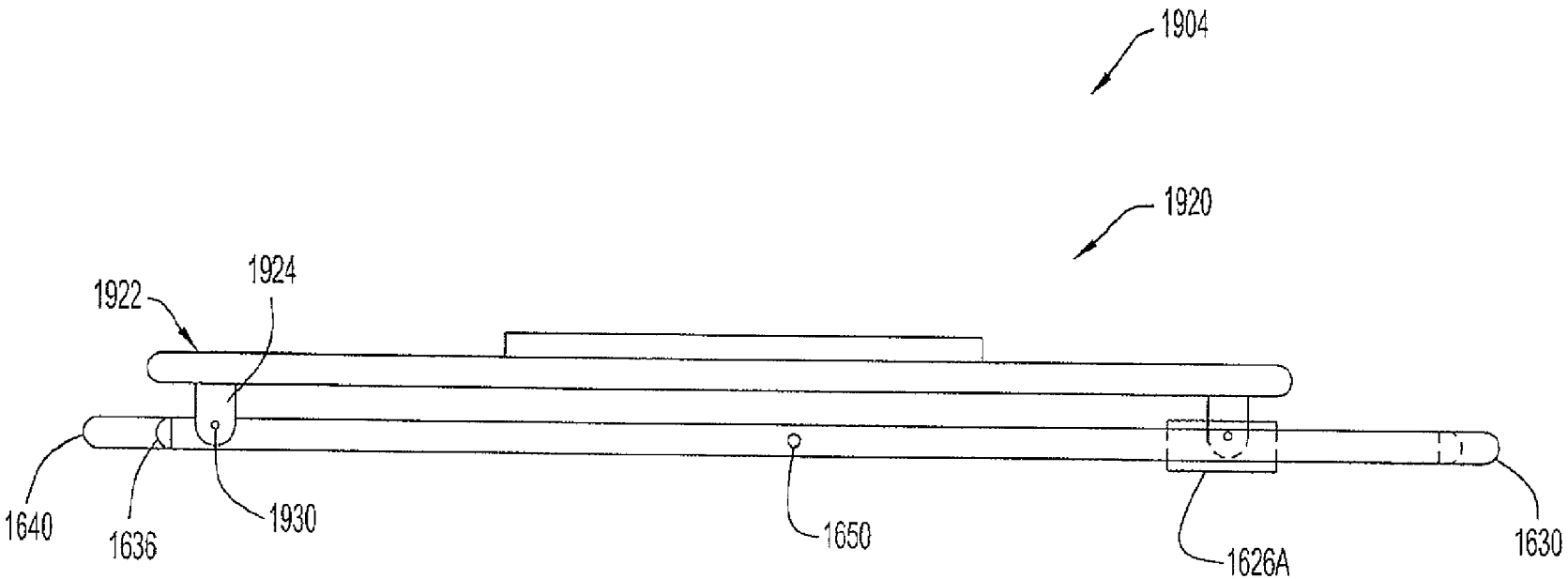
FIG. 20 illustrates a side view of the infant support structure illustrated in FIG. 19 in a collapsed configuration.

FIGS. 19 and 20 illustrate a perspective view of another embodiment of a frame member. The components of frame member 1900 that are similar to components of frame member 1600 illustrated in FIGS. 16-18 have common reference numerals for ease of reference. The frame member 1900 is illustrated in a deployed configuration 1902 in FIG. 19 and in a collapsed configuration 1904 in FIG. 20.

The frame 1900 includes an upper portion 1922 with mounts 1924 and 1926 to which the upper ends 1636 and 1638 of the leg 1630 are pivotally coupled via connectors 1930. In this embodiment, leg 1640 is slidably mounted to the upper portion 1922 in a similar configuration as described with respect to infant support structure 1600. As the leg 1630 pivots relative to the upper portion 1922, leg 1640 slides relative to the upper portion 1922 as the frame is collapsed to its collapsed configuration 1904 illustrated in FIG. 20.

Figure 21:
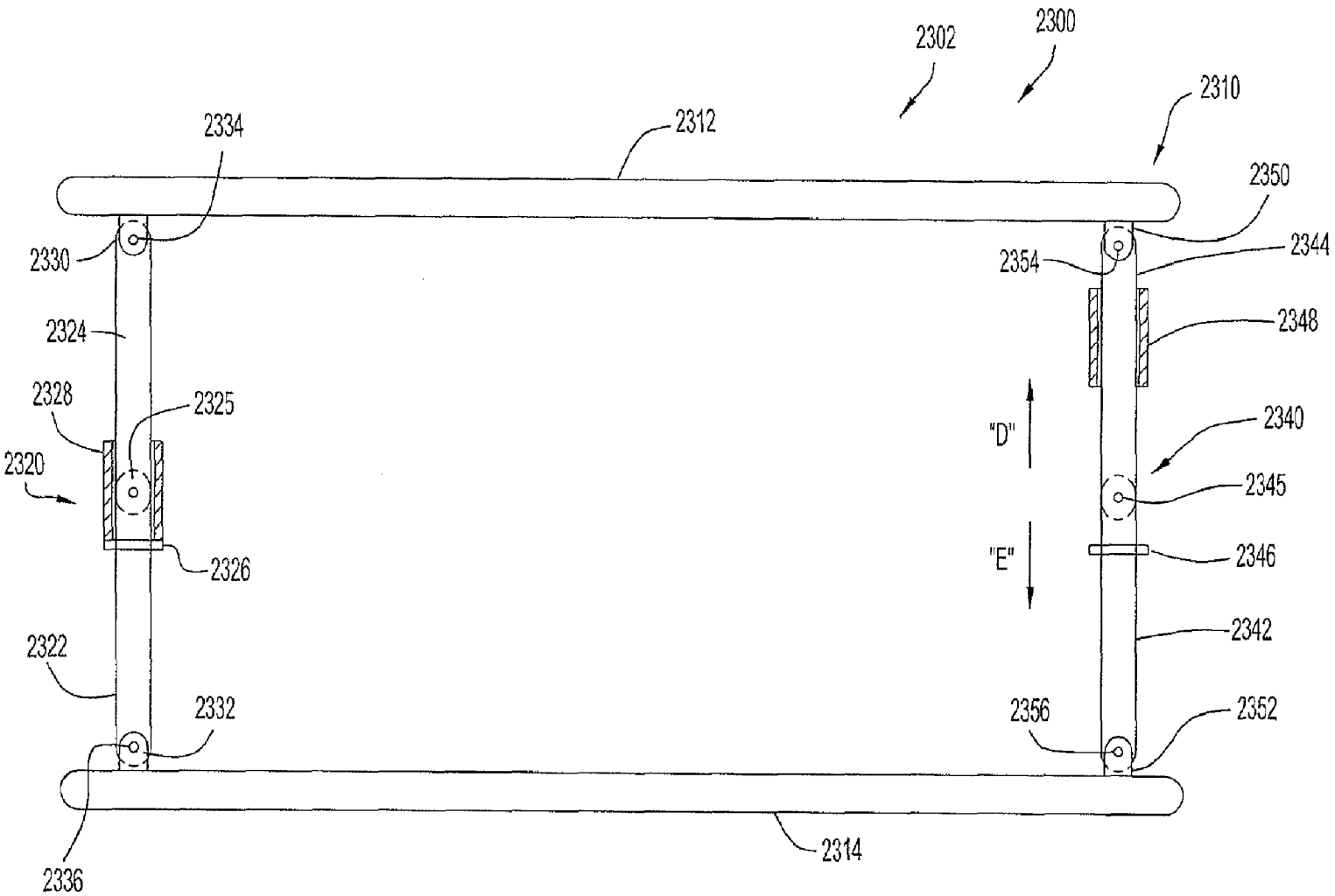
FIG. 21 illustrates a side view of an alternative embodiment of a frame member for an infant support structure according to the invention.
Figure 22:
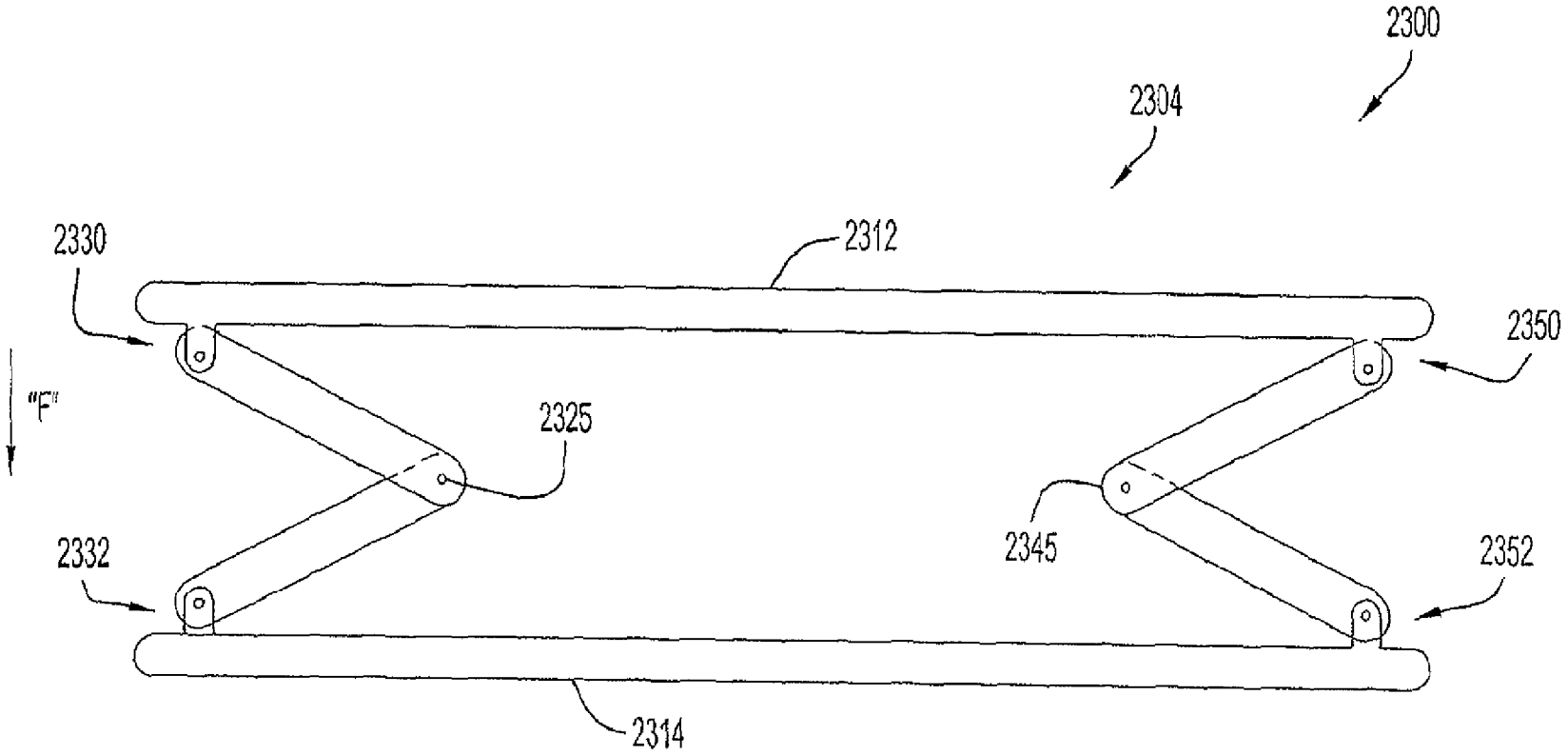
FIG. 22 illustrates a side view of the frame member illustrated in FIG. 21 in a partially collapsed configuration.
Figure 23:
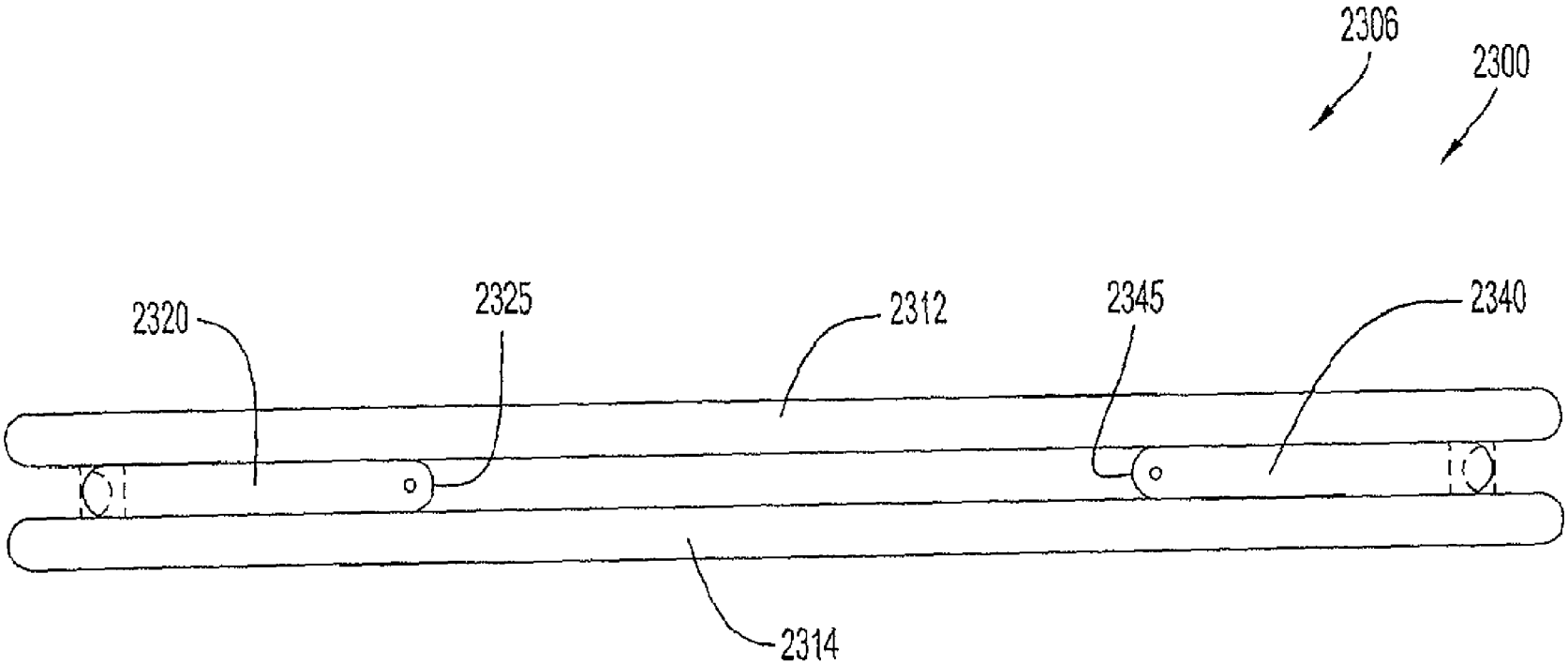
FIG. 23 illustrates a side view of the frame member of FIG. 21 in a collapsed configuration.

Referring to FIGS. 21-23, another embodiment of an infant support structure is illustrated. In this embodiment, the infant support structure 2300 is collapsible and can be placed in a deployed or use configuration 2302 (see FIG. 21), a partially collapsed configuration 2304 (see FIG. 22), and a collapsed configuration 2306 (see FIG. 23).

In this embodiment, the frame member 2310 includes several legs that are coupled to an upper portion 2312 and a lower portion 2314. The upper portions 2312 and the lower portion 2314 may be formed by one or more members, similar to other embodiments described above. In FIGS. 21-23, only two legs of the frame member 2310 are illustrated for each of reference. In other embodiments, the frame member 2310 may include more than two legs.

Referring to FIG. 21, leg 2320 includes an upper leg portion 2324 and a lower leg portion 2322 that are pivotally coupled together via a pivot connection 2325 by a connector, such as a bolt. The upper end of leg portion 2324 is coupled to a mount 2330 on the upper portion 2312 by a connector 2334. The lower end of leg portion 2322 is coupled to a mount 2332 on the lower portion 2314 by a connector 2336.

Similarly, leg 2340 includes an upper leg portion 2344 and a lower leg portion 2342 that are pivotally coupled together via a pivot connection 2345 by a connector, such as a bolt. The upper end of leg portion 2344 is coupled to a mount 2350 on the upper portion 2312 by a connector 2354. The lower end of leg portion 2342 is coupled to a mount 2352 on the lower portion 2314 by a connector 2356.

In one embodiment, each of the legs 2320 and 2340 includes a sleeve 2328 and 2348 slidably mounted thereon. The sleeves 2328 and 2348 are made of a rigid or semi-rigid material. The sleeves 2328 and 2348 are illustrated in FIG. 21 in cross-section and are not illustrated in FIGS. 22-23 for ease of reference. Each of the legs 2320 and 2340 includes a limit or a stop 2326 and 2346 that limits the range of motion of a corresponding sleeve 2328 or 2348. The limits 2326 and 2346 are located so that a sleeve engaged therewith is positioned over the pivoting joint between the leg portions to prevent the relative movement of the leg portions, thereby maintaining the legs in their fully extended configurations.

Referring to FIG. 21, sleeve 2328 on leg 2320 has been moved downwardly along the direction of arrow "E" so that it engages the stop 2326 and is surrounding pivot joint 2325. In this position, the sleeve 2328 prevents the pivot joint 2325 from moving and as a result, the leg portions 2322 and 2324 cannot pivot relative to each other. Accordingly, leg 2320 is maintained in its deployed or use configuration.

Also in FIG. 21, the sleeve 2348 has been moved upwardly along the direction of arrow "D." In this position, the sleeve 2348 does not prevent pivot joint 2345 from moving and as a result, leg 2340 can be collapsed. To collapse the frame 2300, sleeves 2328 and 2348 are both raised along the direction of arrow "D" to move the sleeves 2328 and 2348 upwardly. Conversely, sleeves 2328 and 2348 are lowered over pivot joints 2325 and 2345 and into engagement with stops 2326 and 2346, respectively, to lock the legs 2320 and 2340 in their deployed positions.

Referring to FIG. 22, the legs 2320 and 2340 are collapsible after sleeves 2328 and 2348 (not shown in FIG. 22) have been moved upwardly to their unlocking positions. In the partially collapsed position, the upper and lower leg members 2322, 2324, 2342, and 2344 pivot at pivot joints 2325 and 2345 relative to each other. FIG. 23 shows frame member 2310 in a fully collapsed configuration, which facilitates storage and transportation of the infant support structure 2310.

Figure 24:
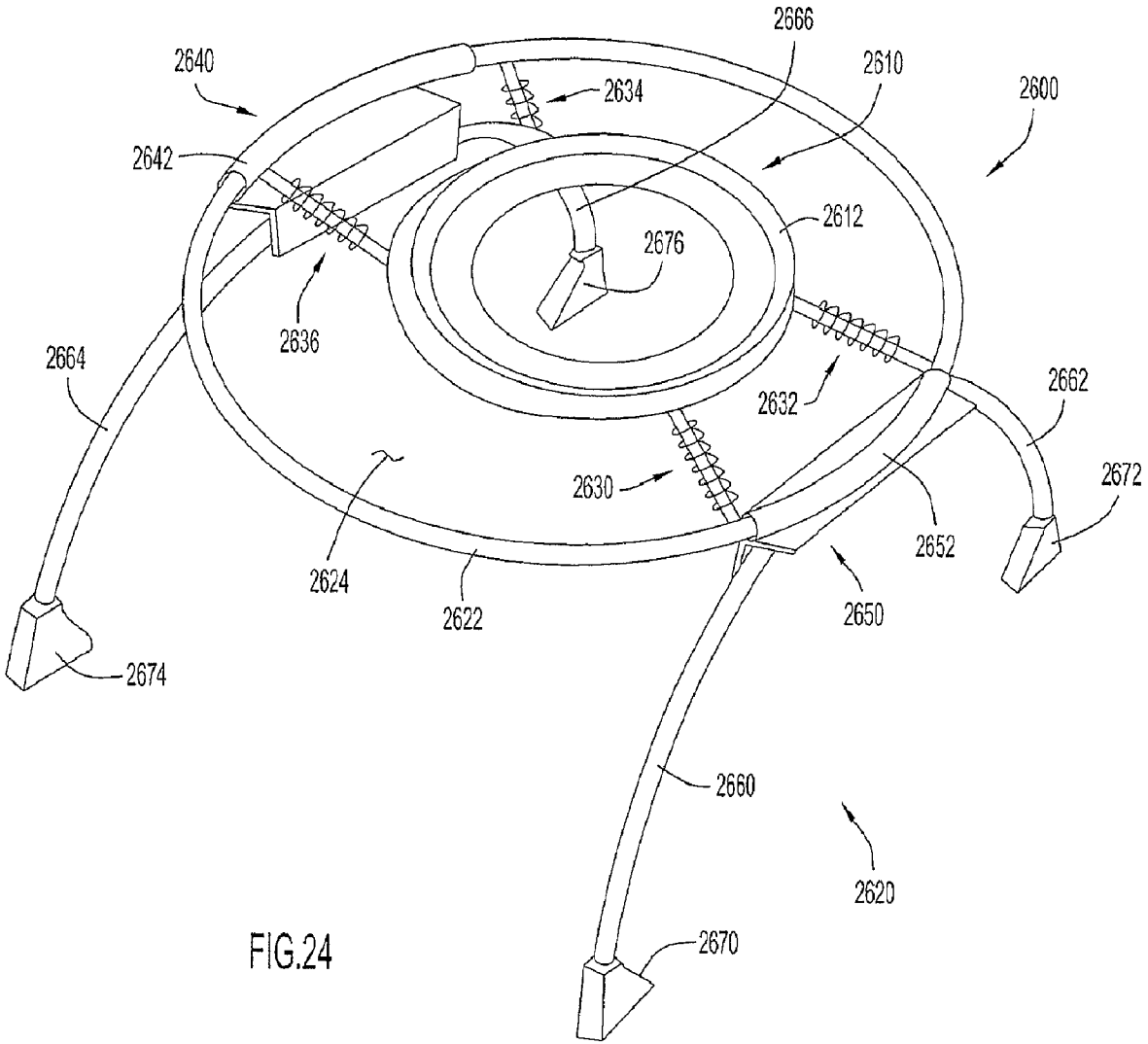
FIG. 24 illustrates a perspective view of an alternative embodiment of an infant support structure.

FIG. 24 shows an alternative embodiment of an infant support structure. In this embodiment, the infant support structure 2600 includes a support portion 2610 and a frame member 2620. On one side, the frame member 2620 includes legs 2660 and 2662, which have feet 2670 and 2672 and are coupled to housing 2650. The legs 2660 and 2662 may be metal, plastic, or other suitable material, and are coupled to the housing 2650 by friction and/or connectors. On the other side, the frame member 2620 includes legs 2664 and 2666, which have feet 2674 and 2676 and are coupled to housing 2640 in a manner similar to legs 2660 and 2662. The feet 2670, 2672, 2674, and 2676 may be made from an anti-slip material to ensure a stable connection between the infant support structure 2600 and a support surface.

The frame member 2620 includes an upper member 2622 that is substantially circular and defines an opening 2624 in which a seat support or portion 2612 is located. Several elastic elements 2630, 2632, 2634, and 2636, such as metallic springs or spring-like members, are connected to and extend between upper member 2622 and the seat portion 2612. The elements may be connected by connectors or fasteners (not shown). Housing 2640 includes a tubular sleeve portion 2642 through which the upper member 2622 extends. Similarly, housing 2650 includes a tubular sleeve portion 2652 through which the upper member 2622 extends.

While not illustrated in FIG. 24, an elastic member can be connected to the upper portion 2622 of the frame 2620 and to seat portion 2612. The elastic member can be placed so that it extend over the elastic elements 2630, 2632, 2634, and 2636. In this embodiment, the elastic elements 2630, 2632, 2634, and 2636 perform generally the same function as flexible members 1250 illustrated in FIG. 12.

Figure 25:
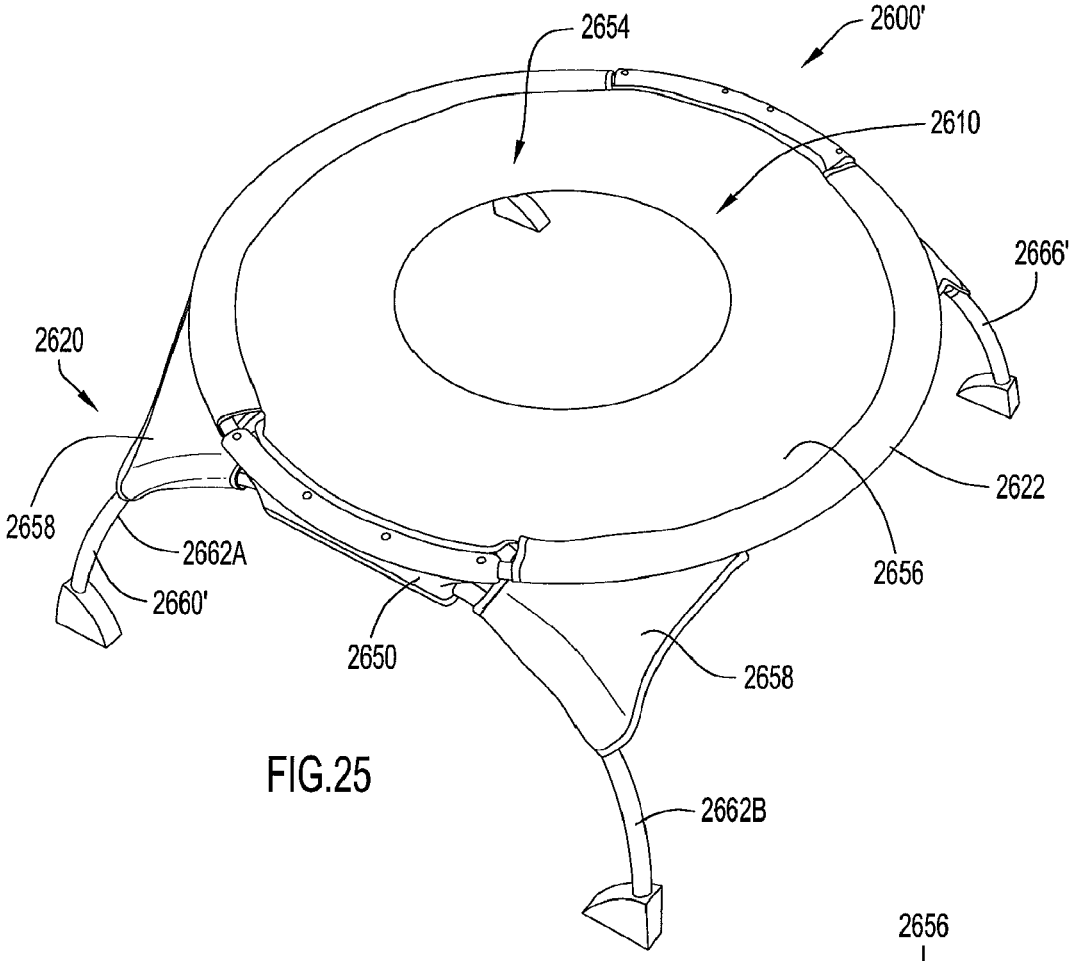
FIG. 25 illustrates a perspective view of another embodiment of an infant support structure according to the invention.

FIG. 25 shows an alternative embodiment of an infant support structure according to the present invention. Some of the reference numerals of components illustrated in FIG. 24 that are similar to components illustrated in FIG. 25 are used for ease of reference. In this embodiment, the infant support structure 2600' includes a support portion 2610 and a frame member 2620. On one side, the frame member 2620 includes a leg 2660' with portions 2662A and 2662B, which are part of a single, formed metal tube. The leg portions 2662A and 2662B have feet 2670 and 2672, respectively. The leg 2660' is coupled to a housing 2650, as described below. The leg 2660' is made of metal, and in alternative embodiments, can be made of plastic, or other suitable material. On the other side, the frame member 2620 includes a leg 2666', which has feet 2674 and 2676 and is coupled to housing 2640 in a manner similar to leg 2660'. The feet 2670, 2672, 2674, and 2676 may be made from an anti-slip material to ensure a stable connection between the infant support structure 2600' and a support surface. In another embodiment, each of the legs 2620' and 2660' can be formed of two or more parts that are coupled together.

The frame member 2620 includes an upper member 2622 that is substantially circular and defines an opening 2624 in which a seat support or portion 2612 is located. In one implementation, the upper member 2622 can be formed using two tubes, such as metal tubes. One of the ends of each tube can be swaged so that it can be inserted into a non-swaged end of the other tube.

In one embodiment, the housing 2650, and the corresponding housing on the opposite side, is formed of multiple portions which capture leg 2660' such that the housing 2650 forms or creates the pivot for the leg 2660'. As described below, the housing 2650 also holds the tubes of the upper member 2622 together. Several elastic elements 2630, 2632, 2634, and 2636, such as metallic springs or spring-like members, are connected to and extend between upper member 2622 and the seat portion 2612. The elements may be connected by connectors or fasteners (not shown). Housing 2640 includes a tubular sleeve portion 2642 through which the upper member 2622 extends. Similarly, housing 2650 includes a tubular sleeve portion 2652 through which the upper member 2622 extends.

Referring to FIG. 25, an elastic member 2654 may be connected to the upper portion 2622 of the frame 2620 and extend about the seat portion 2612. The elastic member 2654 extends over the elastic elements 2630, 2632, 2634, and 2636 (shown in FIG. 24). In this embodiment, the elastic elements 2630, 2632, 2634, and 2636 perform generally the same function as flexible members 1250 illustrated in FIG. 12.

Figure 25B:
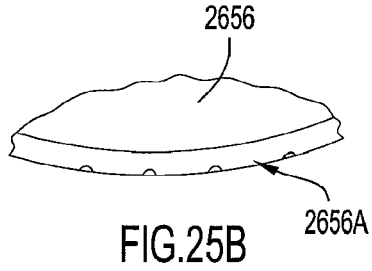
FIG. 25B illustrates a view of a portion of the upper surface portion with part of a softgoods frame strip coupled thereto.
Figure 25A:
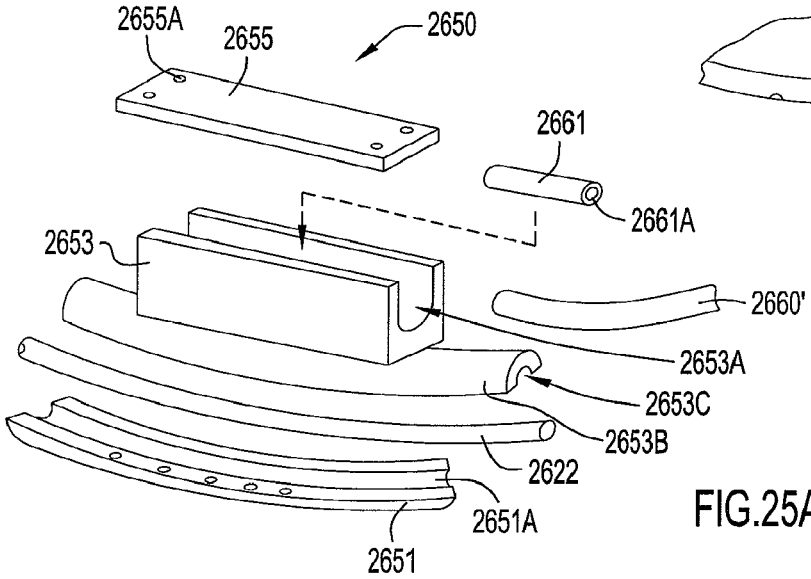
FIG. 25A illustrates a close-up exploded view of the connection of the housing and the leg and upper member of the infant support structure illustrated in FIG. 25.

Referring to FIG. 25A, an exploded view of the housing 2650 is illustrated. The housing 2650 is inverted in this view relative to its orientation in FIG. 25. In this embodiment, the housing 2650 has a top portion 2651, a middle portion 2653, and a bottom portion 2655. The bottom portion 2655 includes four holes through which connectors, such as screws, can be inserted to couple the bottom portion 2655 to the middle portion 2653. The middle portion 2653 includes a surface that defines a channel or passageway 2653A that is sized to receive a leg collar 2661 which has an internal passageway 2661A that receives leg 2660'. The leg collar 2661 can pivot within the passageway 2653A, thereby facilitating the pivoting of leg 2660' relative to the frame. The leg collar 2661 also prevents the sliding of the leg 2660' within the passageway 2653A. The leg 2660' can have a central portion that is substantially linear and not curved. This central portion is the part of the leg 2660' that is mounted in the passageway 2653A and to which the leg collar 2661 is coupled. The substantially linear portion facilitates the pivoting of the leg 2660' relative to the housing 2650.

The middle portion 2653 also includes a curved portion 2653B that has a surface that defines a groove or passageway 2653C as shown. Similarly, the top portion 2651 has a surface that defines a groove or passageway 2651A as well. The grooves 2653C and 2651A collectively define a passageway that receives upper member 2622. Each of the top portion 2651 and the upper member 2622 has corresponding holes through which connectors, such as screws, can be inserted to couple the upper member 2622 and the top portion 2651. As described above, the middle portion 2653 traps the leg 2660' to the upper member 2622.

As shown in FIG. 25B, a softgoods frame strip 2656A, which can be made of plastic, is coupled along the perimeter of the surface 2656. The strip 2656A is trapped between the top housing 2651 and the middle housing 2653 and retained therebetween when the top housing 2651 and the middle housing 2653 are coupled together.

Referring back to FIG. 25, the elastic member 2654 includes an upper surface portion 2656 that performs generally the same function as the elastic member 1330 illustrated in FIG. 13. In addition, the elastic member 2654 includes flaps 2658 which are coupled to and extend between the upper member 2622 and leg 2660'. Similarly configured flaps (not shown) are coupled to and extend between the upper member 2622 and leg 2666'. In one embodiment, the flaps 2658 are formed from a flexible material, such as the same material from which the upper surface portion 2656 is formed, and permit each of the legs 2660' and 2666' to pivot between a deployed position (as shown in FIGS. 24 and 25) and a folded position. The flaps 2658 provide additional stability to the infant support structure 2600 by maintaining the footprint of the legs 2660' and 2666' in the deployed position and restricted continued outward movement of the feet 2670, 2672, 2674, 2676 beyond their fully deployed position. In one embodiment, the surface portion 2656 can be made of a breathable, and wipable material.

Figure 25C:
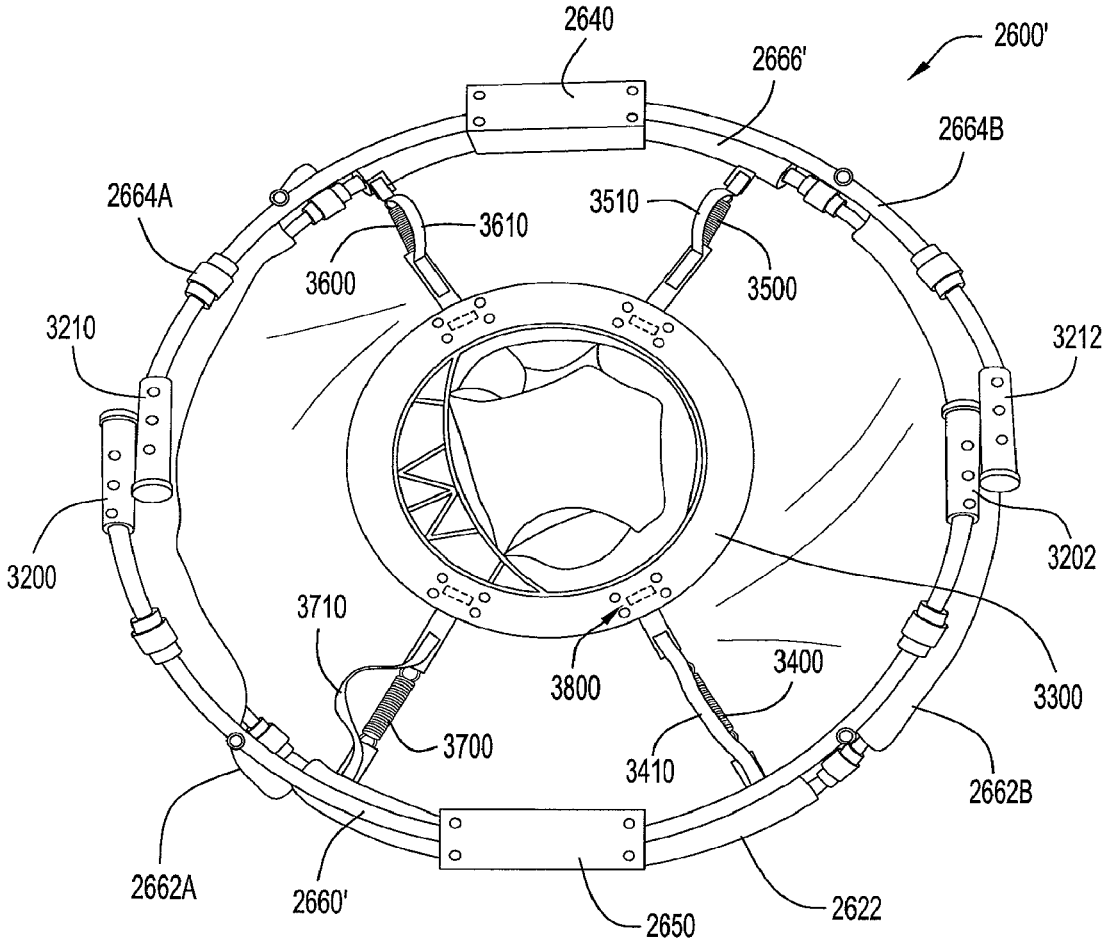
FIG. 25C illustrates a bottom view the infant support structure illustrated in FIG. 25 in a folded or collapsed configuration.

Referring to FIG. 25C, the infant support structure 2600' is illustrated in a folded or collapsed configuration. The legs 2660' and 2666' of the infant support structure 2600' are moved to their folded positions in which the legs 2660' and 2666' are adjacent to and extend along the upper member 2622. Leg 2660' has portions 2662A and 2662B with foot portions 3200 and 3202, respectively. Leg 2666' has portions 2664A and 2664B with foot portions 3210 and 3212, respectively. The legs 2660' and 2666' are not symmetrical, as shown in FIG. 25C, which allows the legs 2660' and 2666' to fold flat without hitting each other.

Figure 25D:
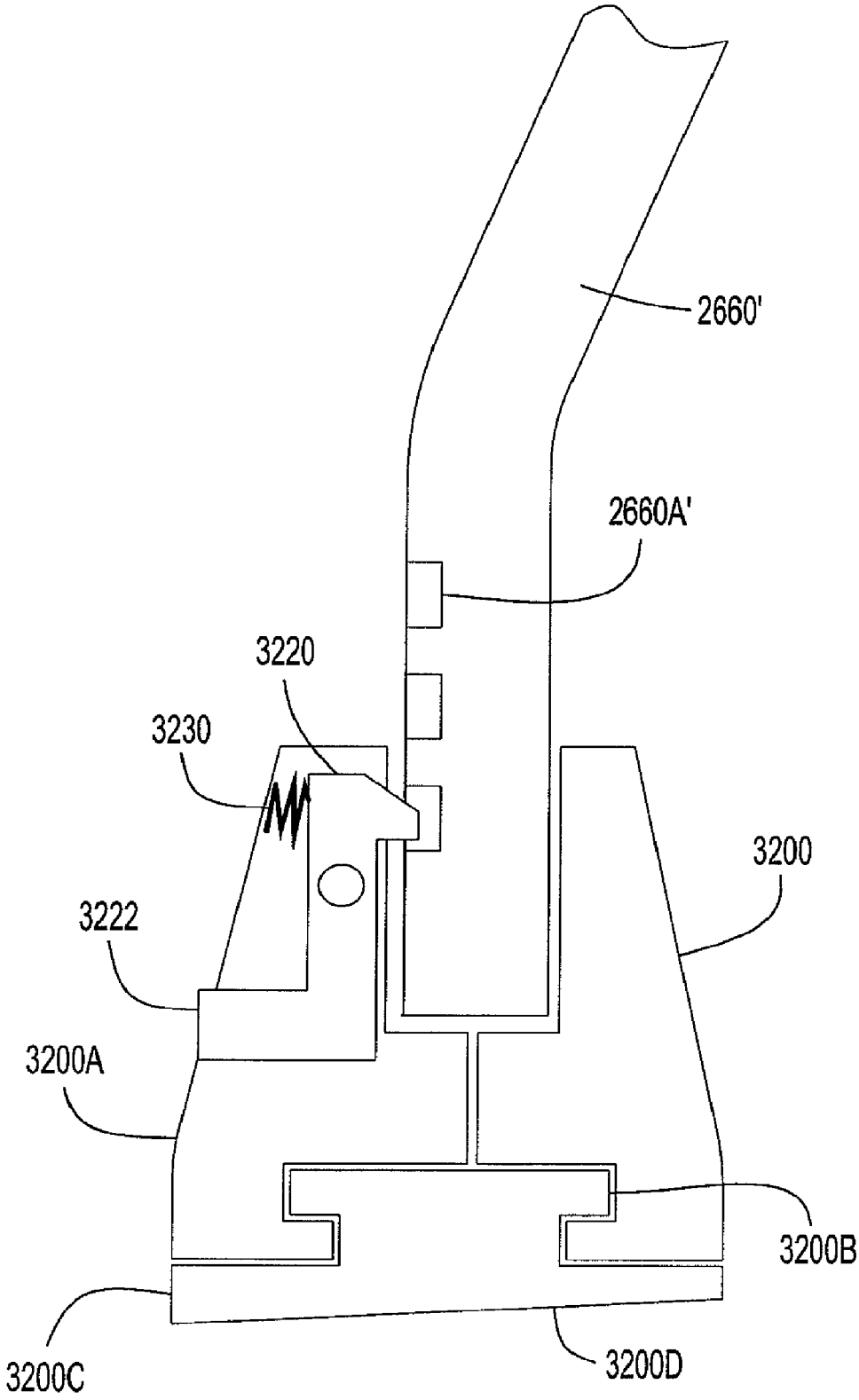
FIG. 25D illustrates a view of a cross-sectional view of a foot of the infant support structure illustrated in FIG. 25C.

Referring to FIG. 25D, a foot 3200 coupled to leg 2660' is illustrated. In this embodiment, the foot 3200 includes foot portions 3200A and 3200B that are coupled together via connectors, such as screws. The foot 3200 also includes a pad portion 3200C, a part of which is captured between the foot portions 3200A and 3200B, that can be placed in contact with a support surface. The pad portion 3200C has an angled orientation to its lower surface 3200D so that the foot 3200 engages the support surface in a desired orientation when the legs of the infant support structure are deployed or unfolded. The foot 3200 includes a release lever 3220 that is biased into a locking position as shown by a biasing member 3230, such as a spring. A user can engage or press end 3222 to move the lever 3220 against the bias of the spring 3230 and remove the other end of the lever 3220 out of engagement with one of the three holes 2660A' in the leg 2660'.

Referring to FIG. 25C, the infant support structure 2600' includes several springs 3400, 3500, 3600, and 3700 that are spaced apart around the seat ring assembly 3300 to support the seat ring assembly 3300 from the upper member 2622. The seat ring assembly 3300 includes a seat ring, a softgoods seat ring, and a seat spring retainer. The softgoods seat ring can rotated on seat rollers relative to the seat ring to facilitate the turning or rotating of an infant support by the seat ring assembly 3300. The softgoods seat ring is trapped between the seat ring and the seat spring retainer, which also trap four spring axles 3800 (shown in phantom), therebetween. The spring axles 3800 are used to mount the springs 3400, 3500, 3600, and 3700.

Each end of the springs is engaged with a fabric tab or webbing that defines an opening through which a portion of the spring end can be inserted. One fabric tab or webbing for a spring is retained by the seat ring assembly 3300. The other or outer end of each spring is engaged with a fabric tab or webbing that is coupled to the upper member 2622.

In one embodiment, each of the springs 3400, 3500, 3600, and 3700 is formed of a wire with a diameter of 0.105 inches, the outer diameter of the spring is 0.75 inches, and the quantity of coils is 20. The springs 3400, 3500, and 3600, 3700 have corresponding fabric strips or webbing 3410, 3510, 3610, and 3710, respectively, that are coupled at their ends to the webbing to which a spring is coupled. In one embodiment, there is a fabric layer that is located beneath the springs 3400, 3500, and 3600, 3700 and their webbing 3410, 3510, 3610, and 3710 and coupled to the fabric sleeve around upper member 2622 and to the seat portion. This fabric layer provides a cover for the springs so that the springs cannot be accessed from below.

Figure 26:
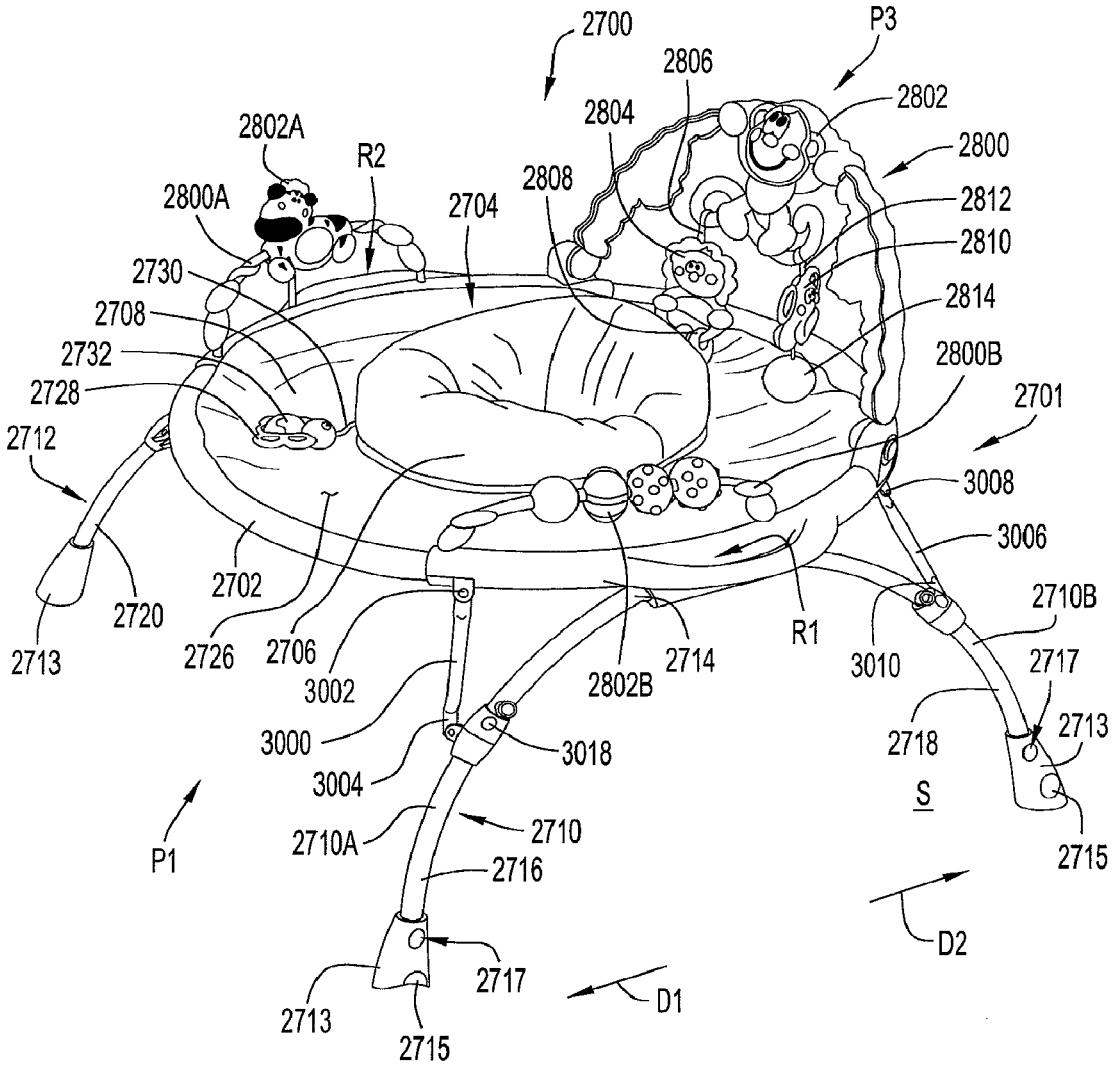
FIG. 26 illustrates a perspective view of another embodiment of an infant support structure according to the invention.
Figure 27:
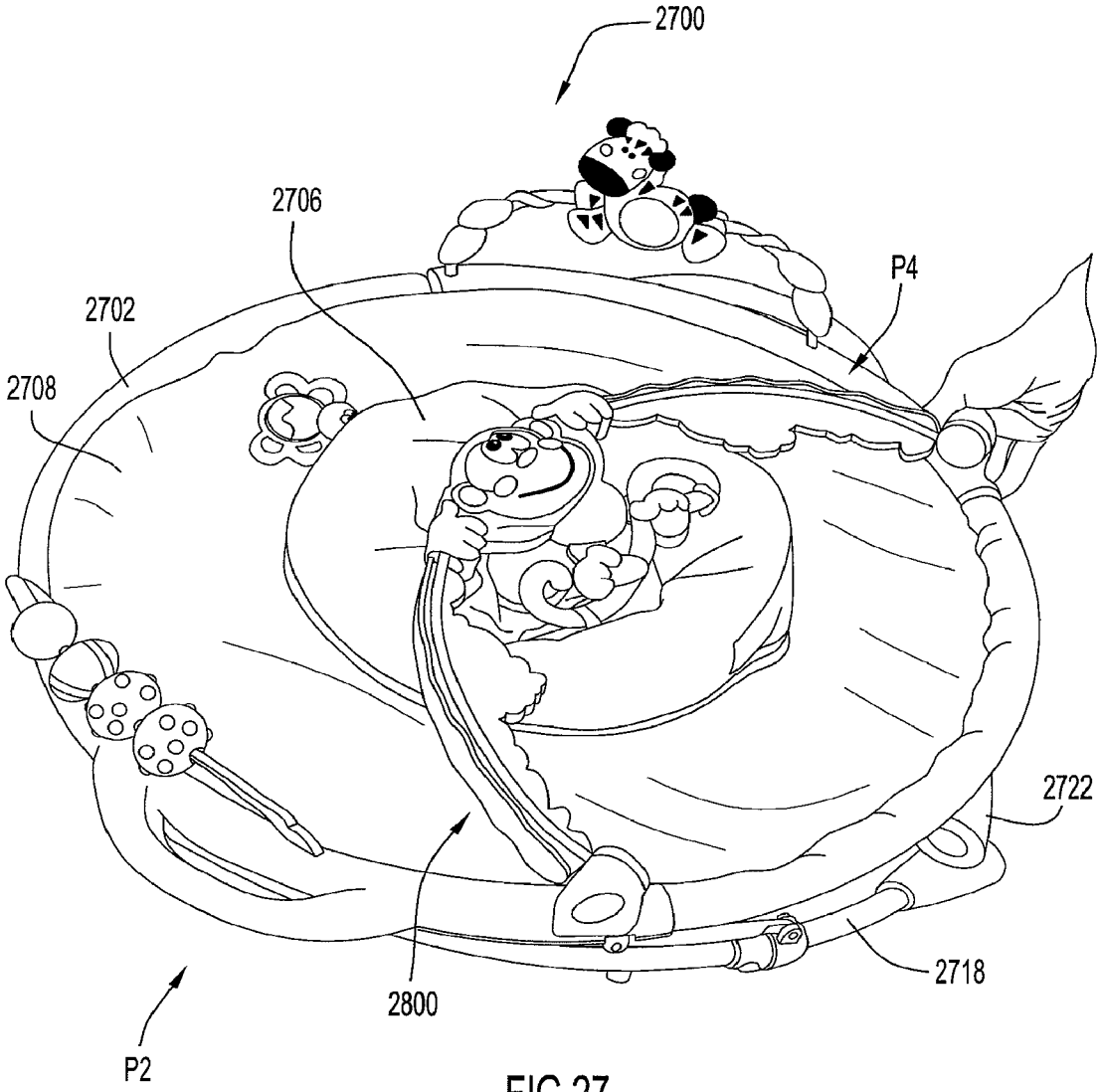
FIG. 27 illustrates a perspective view of the infant support structure of FIG. 26 in a folded position.

Referring to FIGS. 26 and 27, an infant support structure 2700 according to another embodiment is illustrated. The infant support structure 2700 is reconfigurable between a deployed position P1 (shown in FIG. 26) and a collapsed or folded position P2 (shown in FIG. 27).

The infant support structure 2700 includes a frame 2701 having an upper frame member 2702 defining a central area 2704. A seat portion 2706 is disposed in the central area 2704 and movably coupled to the upper frame member 2702 via an elastic portion. The elastic portion may include one or more resilient members as described above, and/or a flexible member 2708 extending between the seat portion 2706 and the upper frame member 2702. The seat portion 2706 is movable toward and away from a plane in which the upper frame member 2702 lies as the elastic portion 2708 extends and contracts, such as described above and as shown in FIG. 4.

Spaced leg members 2710, 2712 are pivotally coupled to the upper frame member 2702 via . In one embodiment, the leg members 2710, 2712 include feet 2713 disposed on distal ends thereof and configured for engaging a support surface S (e.g. the ground or the floor). The feet 2713 may be formed from or include an anti-slip material to ensure stability on the support surface S, as described above. Further, each of the feet 2713 may be movably coupled to the corresponding distal ends of the leg members 2710, 2712 so that the height of the seat portion 2706 relative to the support surface S may be adjusted. For example, each foot 2713 may be telescopically coupled to a corresponding distal end of one of the leg members 2710, 2712, and releasably secured at a selected position thereon via an engagement portion 2715. The engagement portion 2715 may be a spring loaded component which is biased outwardly and into a correspondingly configured opening 2717 in the foot 2713.

In one embodiment, the leg member 2710 has a substantially U-shaped or arcuate configuration. The leg member 2710 includes a central portion 2714 pivotally coupled to the upper frame member 2702 and opposing end portions 2716, 2718 configured for engaging a support surface S (or coupled to or including a foot 2713). The leg member 2712 is similarly configured, and thus includes a central portion pivotally coupled to the upper frame member 2702 and opposing end portions (only end portion 2720 is shown in FIG. 26; end portion 2722 is illustrated in FIG. 27) configured for engaging the support surface S (or coupled to or including a foot 2713).

The leg members 2710, 2712 are pivotally movable so that the infant support structure 2700 may be reconfigured between its deployed position P1 and its folded position P2. In the deployed position P1, the end portions 2716, 2718 of the leg member 2710 and the end portions 2720, 2722 of the other leg member 2712 extend outwardly from the upper frame member 2702, as shown in FIG. 26. In the folded position P2, the end portions 2716, 2718 of the leg member 2710 and the end portions 2720, 2722 of the other leg member 2712 are adjacent the upper frame member 2702, as shown in FIG. 27.

Referring again to FIG. 26, the central portion 2714 of the leg member 2710 rotates or pivots about a pivot point R1 relative to the upper frame member 2702. The central portion of the other leg member 2712 rotates or pivots about another pivot point R2 relative to the upper frame member 2702. In one implementation, the pivot point R1 about which the leg member 2710 pivots is spaced from the pivot point R2 about which the other leg member 2712 pivots by about 180° relative to the periphery of the upper frame member 2702.

With continued reference to FIGS. 26 and 27, the flexible member 2708 substantially surrounds the seat portion 2706. Thus, the flexible member 2708 and the seat portion 2706 are located within the central area 2704 defined by the upper frame member 2702. An upper surface 2726 of the flexible member 2708 is positioned around the seat portion 2706 so that it defines an activity surface accessible to a child disposed within the seat portion 2706. Various objects such as toys or entertainment elements may be coupled to or placed upon the upper surface 2726, such as described above and as shown in FIG. 13. Accordingly, movement and vibrations created by a child bouncing or moving in the seat portion 2706 are imparted to any toys or elements disposed on, coupled to, or otherwise in contact with, the upper surface 2726.

In one embodiment, a toy bar 2800 is coupled to the upper frame member 2702 and extends upwardly therefrom relative to the flexible member 2708. In one embodiment, the toy bar 2800 is pivotally coupled to the upper frame member 2702, and pivotal between an extended position P3 (shown in FIG. 26) extending upwardly relative to the flexible member 2708 and a retracted position P4 (shown in FIG. 27) folded against or adjacent the flexible member 2708, such as for storage or travel.

Referring to FIG. 26, the toy bar 2800 may include one or more entertainment elements coupled thereto. For example, the toy bar 2800 may include a central portion 2802 configured to resemble a stylized monkey character. An entertainment element 2804 configured to resemble a stylized lion character is movably coupled to the central portion 2802 via a flexible cord 2806. The lion entertainment element 2804 may further include rings 2808 movably coupled thereto. Another entertainment element 2810 configured to resemble a stylized elephant character is movably coupled to the central portion 2802 via another flexible cord 2812. The elephant entertainment element 2810 may include a rattle device 2814 movably coupled thereto.

Movement of the frame 2701 and/or the flexible member 2708 are imparted to the toy bar 2800, which in turn imparts movement to the entertainment elements 2804, 2810. As such, the lion entertainment element 2804 and its rings 2808 and the elephant entertainment element 2810 and its rattle device 2814 are caused to move and/or emit a rattling sound. In this way, movement by a child in the seat portion 2706 causes the entertainment elements 2804, 2810 to move, vibrate and/or seemingly dance about all to the delight of the child.

In one embodiment, a portion of one or more of the entertainment elements are coupled to or engageable with the upper surface 2726 of the flexible member 2708. For example, the lion entertainment element 2804 may be coupled to the central portion 2802 of the toy bar 2800 so that the rings 2808 engage the upper surface 2726 at least a portion of the time, such as when the flexible member 2708 is in its upper position or its rest position (as described above and as shown in FIG. 4).

Alternatively or in addition, one or more entertainment elements may be directly coupled to the flexible member 2708, or to the frame 2701, or to the seat portion 2706. For example, another entertainment element 2728 configured to resemble a stylized butterfly is coupled to the seat portion 2706 via a flexible tether or cord 2730, so that the butterfly entertainment element 2728 rests upon and engages the upper surface 2726 of the flexible member 2708. The butterfly entertainment element 2728 moves and bounces about on the upper surface 2726 as the seat portion 2706 and/or the flexible member 2708 move. Further, the butterfly entertainment element 2728 may include a spinner element 2732 rotatably coupled thereto, which moves or spins as the butterfly entertainment element 2728 moves. Alternatively or in addition, other entertainment elements may be coupled to two or more of the flexible member 2708 and/or the frame 2701 and/or the seat portion 2706.

With continued reference to FIG. 26, the infant support structure 2700 may include additional entertainment elements. For example, in one embodiment, an auxiliary toy bar 2800A is coupled to the upper frame member 2702 and extends upwardly therefrom and relative to the flexible member 2708. The toy bar 2800A may be pivotally coupled to the upper frame member 2702. Alternatively, the toy bar 2800A may be removably coupled to the upper frame member 2702, such as via friction fit and/or via associated engagement portions. The toy bar 2800A may include one or more entertainment elements, such as an entertainment element 2802A configured to resemble a stylized zebra character. The zebra entertainment element 2802A may be slidably coupled to and movable along the toy bar 2800A between opposing ends thereof.

Alternatively or in addition, another auxiliary toy bar 2800B may be coupled to the upper frame member 2702. The toy bar 2800B extends upwardly from the upper frame member 2702 and relative to the flexible member 2708. The toy bar 2800B may be pivotally, fixedly and/or removably coupled to the frame 2701. The toy bar 2800B may include one or more entertainment elements, such as an entertainment element 2802B including a plurality of beads configured to resemble sections of a stylized caterpillar character, each of which are slidably movable along the toy bar 2800B and between opposing ends thereof.

Figure 28:
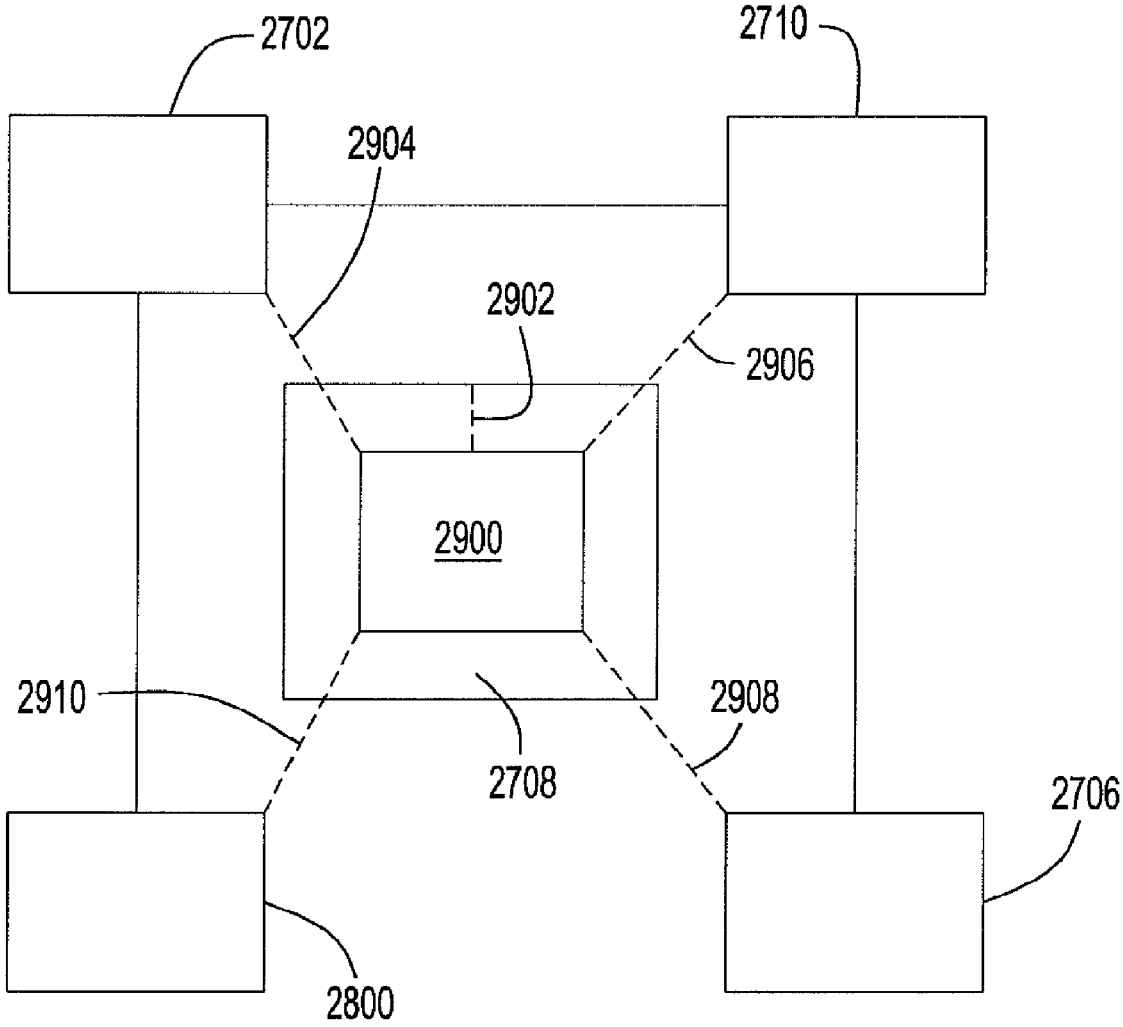
FIG. 28 illustrates a schematic diagram of coupling arrangements of an entertainment element with an infant support structure according to another embodiment of the invention.

Exemplary coupling arrangements of an entertainment element or toy 2900 engageable with the flexible member 2708 are illustrated schematically in FIG. 28. The toy 2900 may be coupled directly to the flexible member 2708 via one or more connection members 2902 (e.g. a flexible cord or tether). Alternatively or in addition, the toy 2900 may be coupled to the upper frame member 2702 via another connection member 2904. Alternatively or in addition, the toy 2900 may be coupled to the leg member 2710 (or 2712) via another connection member 2906. Alternatively or in addition, the toy 2900 may be coupled to the seat portion 2706 via another connection member 2908. Alternatively or in addition, the toy 2900 may be coupled to the toy bar 2800 via another connection member 2910. The toy 2900 is movably coupled so that it is engageable with the flexible member 2708 and movable upon movement of the flexible member 2708, such as when a child moves within the seat portion 2706 and/or contacts the flexible member 2708.

Referring again to FIG. 26, in one embodiment the upper frame member 2702 has a generally circular configuration and thus defines arcuate portions extending about the central area 2704. The leg member 2710 is pivotally coupled to the upper frame member 2702 as noted above, with a leg portion 2710*a* extending outwardly from the pivot point R1 in a first direction D1 and another leg portion 2710*b* extending outwardly from the pivot point R1 in a second direction D2 opposite the first direction D1.

As shown in FIG. 26, a support member 3000 includes an end portion 3002 movably coupled to the upper frame member 2702 and an opposite end portion 3004 movably coupled to the leg portion 2710*a*. Another support member 3006 includes an end portion 3008 movably coupled to the upper frame member 2702 and an opposite end portion 3010 movably coupled to the leg portion 2710*b*.

Figure 29:
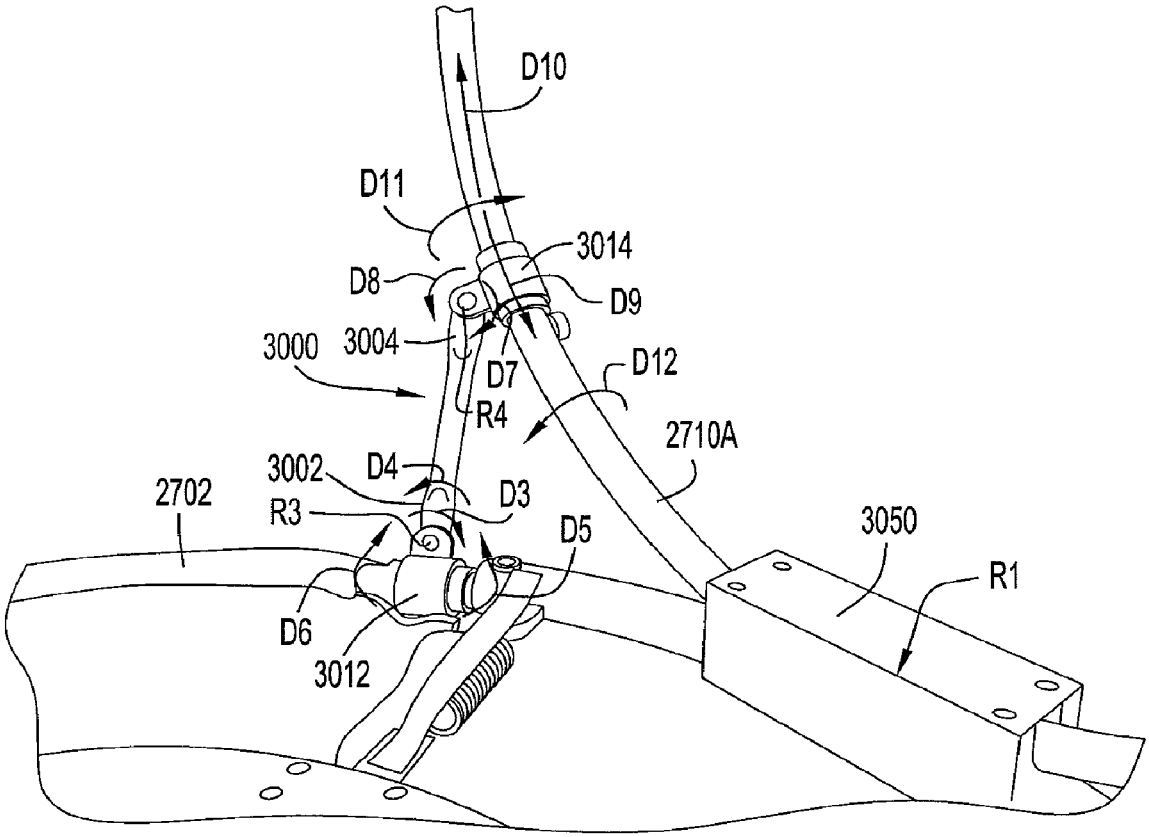
FIG. 29 illustrates a perspective fragmentary view of a portion of an infant support structure according to an embodiment of the invention.

Referring to FIG. 29, the end portion 3002 is pivotal and rotatable relative to the upper frame member 2702. In one implementation, the end portion 3002 is pivotally coupled to a collar member 3012 that is rotatably mounted onto member 2702. The end portion 3002 is movable about a pivot point R3 in opposing directions D3, D4. In addition, the collar member 3012 is rotatable about the longitudinal axis of the upper frame member 2702 in opposing directions D5, D6.

The opposite end portion 3004 is pivotal and slidable relative to the leg portion 2710*a*. In one implementation, the end portion 3004 is pivotally coupled to a slider member 3014 and movable about a pivot point R4 in opposite directions D7, D8. In addition, the slider member 3014 is slidable along the leg portion 2710*a* toward and away from the pivot point R1 and in opposite directions D9, D10 as the leg member 2710 is moved between its deployed position P1 and its folded position P2. Further, the slider member 3014 is rotatable about the longitudinal axis of the leg portion 2710*a* in opposite directions D11, D12.

Figure 30:
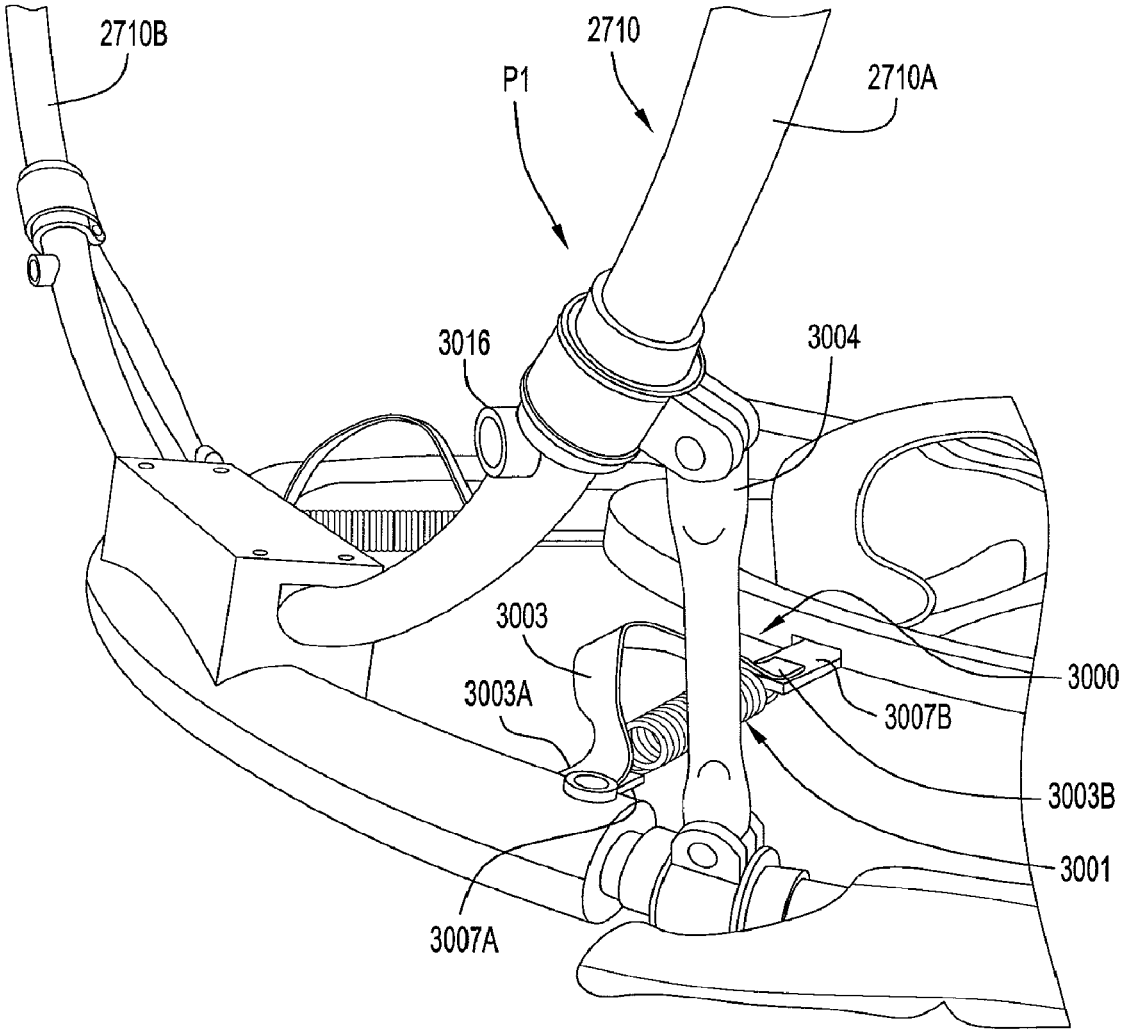
FIG. 30 illustrates a perspective fragmentary view of a portion of the infant support structure illustrated in FIG. 29 showing a support member and a leg member in a deployed position.
Figure 31:
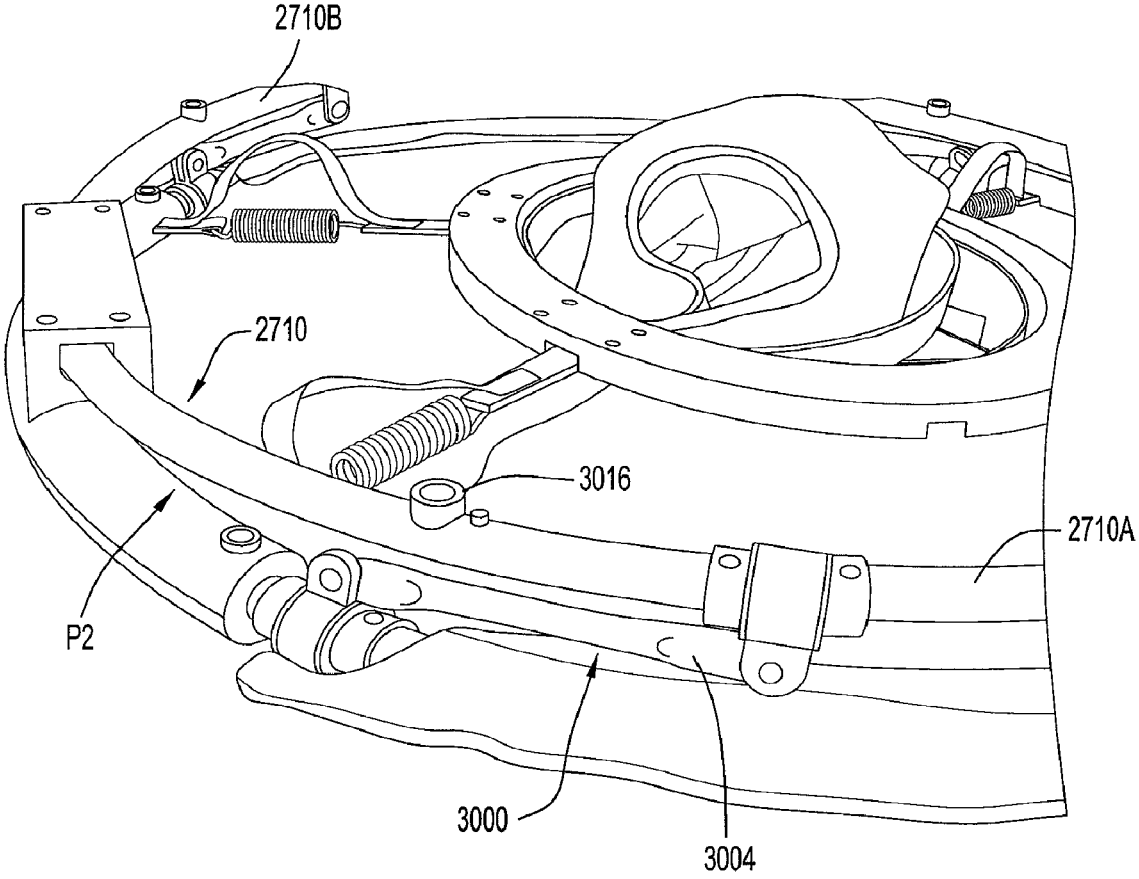
FIG. 31 illustrates a perspective fragmentary view of a portion of the infant support structure illustrated in FIG. 29 showing the support member and the leg member in a folded position.

Referring to FIGS. 30 and 31, as the leg member 2710 is moved between its deployed position P1 (shown in FIG. 30) and its folded position P2 (shown in FIG. 31), the leg member 2710 and the support member 3000 move relative to each other as the end portion 3004 of the support member 3000 slides along the leg portion 2710*a*.

Referring to FIG. 29 also, when moved from its deployed position P1 to its folded position P2, the slider member 3014 rotates about the leg portion 2710*a* in direction D12 as the slider member 3014 moves along the leg portion 2710*a* in direction D10. Further, the end portion 3004 pivots about pivot point R4 in direction D8 as the support member 3000 is folded downwardly and against and/or adjacent the upper frame member 2702. Simultaneously, the collar member 3012 rotates about the upper frame member 2702 in direction D5, and the end portion 3002 pivots about pivot point R3 in direction D4 as the support member 3000 is folded downwardly and against and/or adjacent the upper frame member 2702.

Conversely, when moved from its folded position P2 to its deployed position P1, the slider member 3014 rotates about the leg portion 2710*a* in direction D11 as the slider member 3014 moves along the leg portion 2710*a* in direction D9. The end portion 3004 pivots about pivot point R4 in direction D7 as the support member 3000 is folded upwardly and away from the upper frame member 2702. Simultaneously, the collar member 3012 rotates about the upper frame member 2702 in direction D6, and the end portion 3002 pivots about pivot point R3 in direction D3 as the support member 3000 is folded upwardly and away from the upper frame member 2702.

In one embodiment, the slider member 3014 is restricted from sliding in direction D9 beyond a given point via a stop member 3016. The stop member 3016 is coupled to the leg portion 2710*a* and located thereon so that the slider member 3014 contacts the stop member 3016 when the leg member 2710 is in its fully deployed position P1 (as shown in FIGS. 26 and 30).

Further, in one embodiment, the slider member 3014 is releasably lockable in a predetermined position along the leg portion 2710*a*, such as when the leg member 2710 is in its deployed position P1 and/or in its folded position P2. In this way, the leg member 2710 may be releasably locked in its deployed position P1 and/or in its folded position P2. For example, as shown in FIG. 26, the slider member 3014 may include a release lever or button 3018 operatively coupled to an engagement portion which fits within a correspondingly configured opening disposed in the leg portion 2710*a* when the leg member 2710 is in its deployed position P1. The engagement portion may fit within another correspondingly configured opening disposed in the leg portion 2710*a* when the leg member 2710 is in its folded position P2.

Figure 26A:
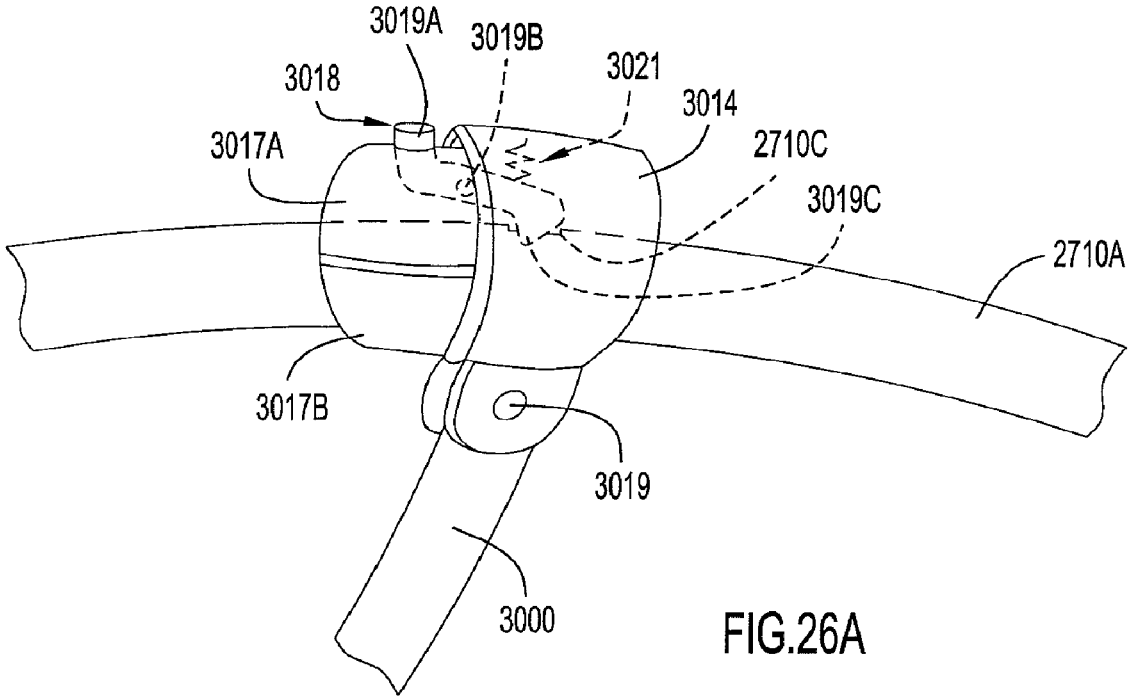
FIG. 26A illustrates a close-up view of a portion of the infant support structure illustrated in FIG. 26.

Referring to FIG. 26A, a close-up view of a portion of the slider or movable member 3014 is illustrated. As discussed, member 3014 moves along and about leg portion 2710*a*. In this embodiment, member 3014 includes housing portions 3017A and 3017B that are coupled together. The release lever 3018 includes an engagement end or portion 3019A that extends outwardly through a hole or opening in housing portion 3017A. The lever 3018 is pivotally mounted about point 3019B and includes an engagement end 3019C. The lever 3018 is biased about point 3019B by a resilient member 3021, such as a spring, so that the engagement end 3019C is biased into engagement with an opening 2710*c* in the leg portion 2710*a*. It is noted that leg portion 2710*a* may include several openings, which would provide for adjustability of the position of the member 3014. To move the member 3014 along the leg portion 2710*a*, the engagement portion 3019A is pressed against the bias of the spring 3021 to remove or disengage the opposite engagement end 3019C from the opening 2710C.

Thus, the leg member 2710 may be releasably secured and maintained in a selected position (e.g. its deployed position P1 or its folded position P2). In this way, the possibility that the leg member 2710 will undesirably pivot about pivot point R1 and relative to the upper frame member 2702, such as when a child is disposed in the seat portion 2706 or when the support structure has been folded for storage or travel, is eliminated or substantially minimized.

The support member 3006 that is movably coupled to the upper frame member 2702 and the other leg portion 2710*b* is similarly configured, as described above and as shown in FIGS. 28, 29 and 30. Further, additional support members may be movably coupled to the upper frame member 2702 and the other leg member 2012, which are also similarly configured as described above and as shown in FIGS. 28, 29 and 30. Accordingly, in one embodiment, four support members may be provided, two of which are movably coupled to the leg member 2710 (e.g. support members 3000 and 3006) and the other two of which are movably coupled to the leg member 2712. In other embodiments, fewer or more support members may be provided.

Referring back to FIG. 30, a biasing mechanism or spring 3001 and a limit mechanism or webbing 3003 are illustrated. In this embodiment, the biasing mechanism 3001 is a spring with several loops and ends having hooked portions 3001A and 3001B that can be engaged with corresponding openings in fabric tabs or webbing that are coupled to the seat portion and the outer frame portion, similar to that described above. The resilient characteristics of the biasing mechanism 3001 facilitate the bouncing motion of a child relative to the frame. The limit mechanism 3003 is a fixed length fabric strap that has its opposite ends 3003A and 3003B coupled to the seat portion and the outer frame portion by stitching. The limit mechanism 3003 limits the range of motion of the biasing mechanism 3001 and the seat portion relative to the outer frame.

It is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Further, although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the appended claims.

What is claimed is:

1. An infant support structure, comprising:

an upper frame member including an arcuate portion, the upper frame member defining a central area;

a seat disposed in the central area and coupled to the upper frame member;

a leg member pivotally coupled to the upper frame member and movable between a deployed position extending outwardly from the upper frame member and a folded position adjacent the upper frame member; and a support member having a first end movably coupled to the upper frame member and an opposite second end pivotally and slidably coupled to the leg member, the second end slidable along the leg member as the leg member is moved between the deployed position and the folded position.

2. The infant support structure of claim 1, wherein the leg member and the second end of the support member move relative to each other as the second end slides along the leg member.

3. The infant support structure of claim 1, wherein the second end of the support member is releasably lockable in a predetermined position along the leg member, the leg member releasably locked in the deployed position when the second end is releasably locked in the predetermined position.

4. The infant support structure of claim 2, wherein the leg member rotates within the second end of the support member as the second end slides along the leg member.

5. The infant support structure of claim 1, wherein the first end of the support member is rotatably coupled to the upper frame member.

6. The infant support structure of claim 1, wherein the leg member has a substantially U-shaped configuration.

7. The infant support structure of claim 1, wherein the leg member is a first leg member, and the infant support structure further comprises a second leg member pivotally coupled to the frame member and movable between a deployed position extending outwardly from the frame member and a folded position adjacent the frame member.

8. The infant support structure of claim 7, wherein the first leg member pivots about a first pivot point relative to the frame member, and the second leg member pivots about a second pivot point relative to the frame member, the first pivot point and the second pivot point spaced about the frame member by about 180°.

9. An infant support structure, comprising:

a frame member defining a central area;

a seat disposed in the central area and movably coupled to the frame member; and a leg member having an arcuate portion pivotally coupled to the frame member and opposing ends, the ends of the leg member movable between a deployed position extending outwardly from the frame member and a folded position adjacent the frame member.

10. The infant support structure of claim 9, further comprising a support member having a first end rotatably coupled to the frame member and an opposite second end pivotally and slidably coupled to the leg member, the second end being slidable toward and away from a pivot point about which the leg member and frame member pivot as the leg member is moved between the deployed position and the folded position.

11. The infant support structure of claim 9, wherein the leg member is a first leg member, and the infant support structure further comprises a second leg member pivotally coupled to the frame member and having opposing ends movable between a deployed position extending outwardly from the frame member and a folded position adjacent the frame member.

12. The infant support structure of claim 11, wherein the first leg member pivots about a first pivot point relative to the frame member, and the second leg member pivots about a second pivot point relative to the frame member, the first pivot point and the second pivot point spaced about the frame member by about 180°.

13. The infant support structure of claim 11, wherein each of the first and second leg members has a substantially U-shaped configuration.

14. The infant support structure of claim 9, wherein the seat is coupled to the frame member via a resilient member and movable toward and away from a plane in which the frame member lies as the resilient member extends and contracts.

15. An infant support structure, comprising:

a frame member having an upper portion defining a central area;

a seat disposed in the central area and coupled to the upper portion of the frame member;

a flexible member extending between the upper portion of the frame member and the seat;

an entertainment element coupled to one of the upper portion of the frame member or the flexible member or the seat, the entertainment element being engageable with the flexible member and movable upon movement of the flexible member.

16. The infant support structure of claim 15, wherein the flexible member substantially surrounds the seat.

17. The infant support structure of claim 15, wherein the upper portion of the frame member includes a support member defining the central area, and the flexible member and the seat are located in the central area.

18. The infant support structure of claim 17, wherein the upper portion includes a toy bar coupled to the support member, the toy bar extends upwardly relative to the flexible member, and the entertainment element is coupled to the toy bar.

19. The infant support structure of claim 18, wherein the toy bar is pivotally coupled to the support member and movable between an extended position extending upwardly relative to the flexible member and a retracted position adjacent the flexible member.

20. The infant support structure of claim 15, wherein the entertainment element includes a first portion connected to the upper portion of the frame member and a second portion coupled to the flexible member.

* * * * *